US008901063B2

(12) United States Patent
Soontravanich et al.

(10) Patent No.: US 8,901,063 B2
(45) Date of Patent: Dec. 2, 2014

(54) APE-FREE LAUNDRY EMULSIFIER

(71) Applicant: Ecolab USA Inc., St. Paul, MN (US)

(72) Inventors: Sukhwan Soontravanich, Bangkok (TH); Stephan Hubig, Northfield, MN (US); Yang Zhang, Shanghai (CN)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 13/689,876

(22) Filed: Nov. 30, 2012

(65) Prior Publication Data

US 2014/0155312 A1 Jun. 5, 2014

(51) Int. Cl.

| | |
|---|---|
| ***C11D 1/72*** | (2006.01) |
| ***C11D 1/722*** | (2006.01) |
| ***C11D 1/825*** | (2006.01) |
| ***B08B 3/04*** | (2006.01) |
| ***C11D 3/20*** | (2006.01) |
| ***C11D 3/37*** | (2006.01) |
| ***B08B 1/00*** | (2006.01) |
| *C11D 1/00* | (2006.01) |

(52) U.S. Cl.

CPC ..... *C11D 1/8255* (2013.01); *C11D 3/2041* (2013.01); *C11D 3/2006* (2013.01); *C11D 1/008* (2013.01); *C11D 3/3707* (2013.01); *C11D 3/2065* (2013.01); *B08B 1/00* (2013.01); *C11D 3/2068* (2013.01); *C11D 1/72* (2013.01)

USPC ..... 510/421; 510/356; 510/360; 510/413; 510/475; 510/505; 510/535; 134/25.2; 134/25.3; 134/39; 134/42; 8/137

(58) Field of Classification Search

USPC ..... 510/356, 360, 413, 421, 475, 505, 535; 134/25.2, 25.3, 39, 42; 8/137

See application file for complete search history.

(56) References Cited

U.S. PATENT DOCUMENTS

| | | | | |
|---|---|---|---|---|
| 3,048,548 | A | | 8/1962 | Martin et al. |
| 3,334,147 | A | | 8/1967 | Brunelle et al. |
| 3,442,242 | A | | 5/1969 | Laskey et al. |
| 5,078,301 | A | | 1/1992 | Gladfelter et al. |
| 5,364,552 | A | * | 11/1994 | Merz et al. ..... 510/340 |
| 5,468,423 | A | | 11/1995 | Garabedian, Jr. et al. |
| 5,656,280 | A | | 8/1997 | Herb et al. |
| 5,977,048 | A | | 11/1999 | Welch et al. |
| 6,022,547 | A | | 2/2000 | Herb et al. |

(Continued)

FOREIGN PATENT DOCUMENTS

| | | |
|---|---|---|
| DE | 2243307 C2 | 3/1974 |
| DE | 2301728 C2 | 7/1974 |

(Continued)

OTHER PUBLICATIONS

Ecolab USA Inc., PCT/US2013/071548 "Notification of Transmittal of the International Search Report and The Written Opinion of The International Searching Authority, or The Declaration" mailed Mar. 21, 2014.

*Primary Examiner* — Brian P Mruk

(74) *Attorney, Agent, or Firm* — McKee, Voorhees & Sease

(57) ABSTRACT

A detergent emulsifier for laundry and other hard surface cleaning using an APE-free surfactant blend is disclosed. The emulsifier system is efficacious for removal of oily soils and greasy food removal. The compositions according to the invention include linear and branched fatty alcohol ethoxylates and ethoxylate propoxylate block copolymers. Methods of using the same are disclosed.

29 Claims, 14 Drawing Sheets

(56) References Cited

U.S. PATENT DOCUMENTS

| | | | |
|---|---|---|---|
| 6,290,943 | B1 | 9/2001 | Naser et al. |
| 6,310,015 | B1 | 10/2001 | Diez et al. |
| 6,387,870 | B1 | 5/2002 | Klaers et al. |
| 6,413,908 | B1 | 7/2002 | Reekmans et al. |
| 6,440,910 | B1 | 8/2002 | Smith et al. |
| 6,525,015 | B2 | 2/2003 | Man et al. |
| 6,608,023 | B2 | 8/2003 | Klaers et al. |
| 6,673,760 | B1 | 1/2004 | Lentsch et al. |
| 6,673,765 | B1 | 1/2004 | Schulz et al. |
| 6,689,728 | B2 | 2/2004 | Diez |
| 6,716,805 | B1 | 4/2004 | Sherry et al. |
| 6,737,553 | B1 | 5/2004 | Maas et al. |
| 6,786,223 | B2 | 9/2004 | Klinkhammer et al. |
| 6,846,793 | B1 | 1/2005 | Griese |
| 6,881,711 | B1 | 4/2005 | Gershun et al. |
| 6,906,230 | B1 | 6/2005 | Maas et al. |
| 7,256,317 | B2 | 8/2007 | Maas et al. |
| 7,291,586 | B2 | 11/2007 | Boone et al. |
| 7,504,373 | B2 | 3/2009 | Dailey et al. |
| 7,530,361 | B2 | 5/2009 | Killeen et al. |
| 7,749,282 | B2 | 7/2010 | Fine et al. |
| 7,893,012 | B2 | 2/2011 | Tjelta et al. |
| 7,919,451 | B2 | 4/2011 | Detering et al. |
| 7,943,563 | B2 | 5/2011 | Schlosser |
| 7,977,299 | B2 | 7/2011 | Hoyt et al. |
| 8,119,585 | B2 | 2/2012 | Lei et al. |
| 8,206,511 | B2 | 6/2012 | Collazo-Martinez et al. |
| 8,222,196 | B2 | 7/2012 | Smith et al. |
| 8,247,363 | B2 | 8/2012 | Fernholz et al. |
| 2003/0136942 | A1 | 7/2003 | Smith et al. |
| 2003/0139310 | A1 | 7/2003 | Smith et al. |
| 2003/0162685 | A1 | 8/2003 | Man et al. |
| 2004/0157760 | A1 | 8/2004 | Man et al. |
| 2004/0157762 | A1 | 8/2004 | Meinke et al. |
| 2006/0057097 | A1 | 3/2006 | Derici et al. |
| 2006/0079414 | A1 | 4/2006 | Nieendick et al. |
| 2006/0234900 | A1 | 10/2006 | Olson et al. |
| 2007/0123447 | A1* | 5/2007 | Killeen et al. ..... 510/475 |
| 2008/0234160 | A1 | 9/2008 | Wenzel et al. |
| 2008/0254983 | A1 | 10/2008 | Panayi et al. |
| 2009/0324505 | A1 | 12/2009 | Seidling et al. |
| 2010/0144581 | A1 | 6/2010 | Nekmard |
| 2010/0229897 | A1 | 9/2010 | Miralles et al. |
| 2010/0234457 | A1 | 9/2010 | Taranta et al. |
| 2010/0240752 | A1 | 9/2010 | Dreilinger et al. |
| 2010/0284955 | A1 | 11/2010 | Lepilleur et al. |
| 2011/0039748 | A1 | 2/2011 | Dedominicis et al. |
| 2011/0094044 | A1* | 4/2011 | Shamayeli et al. ..... 8/137 |
| 2011/0195035 | A1 | 8/2011 | Vondruska et al. |
| 2012/0066839 | A1 | 3/2012 | Man et al. |
| 2012/0066840 | A1 | 3/2012 | Man et al. |
| 2012/0129699 | A1 | 5/2012 | Sowa et al. |
| 2012/0199249 | A1 | 8/2012 | Almen et al. |
| 2012/0291815 | A1 | 11/2012 | Monsrud et al. |

FOREIGN PATENT DOCUMENTS

| | | | |
|---|---|---|---|
| DE | 2916656 | A1 | 11/1980 |
| EP | 0709450 | A1 | 5/1996 |
| WO | WO 96/18711 | A1 | 6/1996 |
| WO | WO 02/081610 | A1 | 10/2002 |
| WO | WO 2004/099355 | A1 | 11/2004 |

* cited by examiner

APE-FREE LAUNDRY EMULSIFIER

FIELD OF THE INVENTION

The present invention relates to a detergent for laundry and other hard surface cleaning system which uses an APE-free surfactant blend. In particular, an emulsifier system including linear and branched fatty alcohol ethoxylates and ethoxylate propoxylate block copolymers is provided for laundry and other hard surface cleaning applications providing oily soil and greasy food removal.

BACKGROUND OF THE INVENTION

Conventional detergents used in the laundering industries and various other cleaning applications, particularly those intended for institutional use, generally contain alkyl phenol ethoxylates (APEs). APEs are used in detergents as a cleanser and a degreaser for their effectiveness at removing soils containing grease from a variety of surfaces. Commonly used APEs include nonyl phenol ethoxylates (NPE) surfactants.

However, while effective, APEs are disfavored due to environmental concerns. For example, NPEs are formed through the combination of ethylene oxide with nonylphenol (NP). Both NP and NPEs exhibit estrogen-like properties and may contaminate water, vegetation and marine life. NPE is also not readily biodegradable and remains in the environment or food chain for indefinite time periods. There is therefore a need in the art for an environmentally friendly and biodegradable alternative that can replace APEs in hard surface cleaners and laundry detergents.

Accordingly, it is an objective of the claimed invention to develop NPE-free laundry detergent emulsifiers and other hard surface cleaning detergent emulsifiers.

A further object of the invention is to provide NPE-free laundry detergents and other hard surface cleaning detergents that provide effective soil removal, including oily soils, such that organic grease, fat and oils are emulsified.

A further object of the invention is to provide the NPE-free compositions without using harsh solvents in place of the NPEs or other APEs, which again may cause environmental concerns such as high content of volatile organic compounds (VOCs), biodegradability, aqua toxicity, etc.

BRIEF SUMMARY OF THE INVENTION

The present invention provides laundry emulsifiers and/or hard surface cleaning compositions which include an environmentally friendly surfactant and/or surfactant blend that works at least as well as NPE. In one embodiment, the present invention is a laundry and/or cleaning composition that is a concentrated pre-treatment or pre-soak NPE-free composition. The cleaning composition is substantially free of alkyl phenol ethoxylates, or preferably is free of alkyl phenol ethoxylates.

In an embodiment, the present invention is a composition comprising from about 40 wt-% to about 95 wt-% of a nonionic surfactant blend, wherein the surfactant blend comprises a fatty alcohol ethoxylate, a Guerbet alcohol ethoxylate or a Guerbet ethoxylate, and an ethylene oxide-propylene oxide copolymer, and optionally from about 0.1 wt-% to about 25 wt-% stabilizers and/or water.

In a further embodiment, the present invention is a concentrated pre-treatment or pre-soak NPE-free composition comprising: a fatty alcohol ethoxylate; a Guerbet alcohol ethoxylate or a Guerbet ethoxylate; an ethylene oxide-propylene oxide copolymer; at least one stabilizing agent; and water; wherein the ratio of said fatty alcohol ethoxylate to said Guerbet alcohol ethoxylate or a Guerbet ethoxylate to said ethylene oxide-propylene oxide copolymer is from about 1:1:1 to about 10:1:10.

In a still further embodiment, the present invention is a method of removing soils from a surface. The method includes removing stains from fabric or hard surfaces comprising the steps of: contacting a soiled article or surface with an aqueous composition comprising from about 40 wt-% to about 95 wt-% of a nonionic surfactant blend, wherein the surfactant blend comprises a fatty alcohol ethoxylate, a Guerbet alcohol ethoxylate or a Guerbet ethoxylate, and an ethylene oxide-propylene oxide copolymer, and optionally from about 0.1 wt-% to about 25 wt-% stabilizers and/or water, for a period of time sufficient to achieve removal of soils from said article or surface; and thereafter cleaning or laundering the treated article or surface with a conventional aqueous detergent.

In an embodiment of the invention, the methods of removing soils from a surface may be employed either inside or outside a washing machine, when employing a method of removing soils from a laundry application. In some aspects, when the aqueous composition is employed outside the washing machine it is used in a concentrated formulation. In some aspects, when the aqueous composition is employed inside the washing machine it is used in a diluted (or a highly diluted) formulation, such as within the wash liquor of a washing machine.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
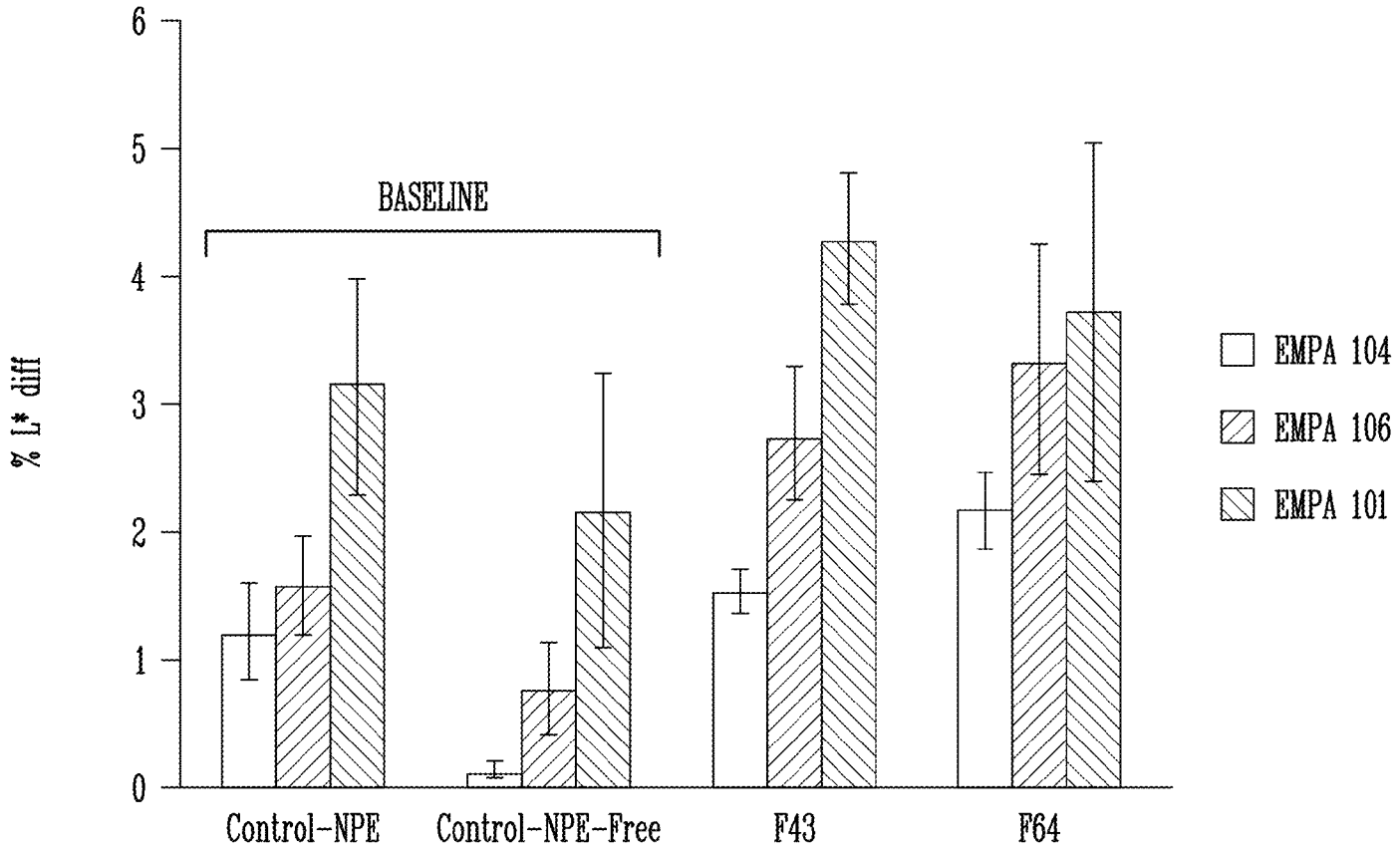
FIG. 1 shows a graph of soil removal capacity of compositions according to embodiments of the invention against various soils on various fabrics in comparison to baseline NPE-containing and NPE-free control compositions.

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENT

The embodiments of this invention are not limited to particular laundry or hard surface cleaning compositions and methods of using the same, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, the term "alkyl" or "alkyl groups" refers to saturated hydrocarbons having one or more carbon atoms, including straight-chain alkyl groups (e.g., methyl, ethyl, propyl, butyl, pentyl, hexyl, heptyl, octyl, nonyl, decyl, etc.), cyclic alkyl groups (or "cycloalkyl" or "alicyclic" or "carbocyclic" groups) (e.g., cyclopropyl, cyclopentyl, cyclohexyl, cycloheptyl, cyclooctyl, etc.), branched-chain alkyl groups (e.g., isopropyl, tert-butyl, sec-butyl, isobutyl, etc.), and alkyl-substituted alkyl groups (e.g., alkyl-substituted cycloalkyl groups and cycloalkyl-substituted alkyl groups).

Unless otherwise specified, the term "alkyl" includes both "unsubstituted alkyls" and "substituted alkyls." As used herein, the term "substituted alkyls" refers to alkyl groups having substituents replacing one or more hydrogens on one or more carbons of the hydrocarbon backbone. Such substituents may include, for example, alkenyl, alkynyl, halogeno, hydroxyl, alkylcarbonyloxy, arylcarbonyloxy, alkoxycarbonyloxy, aryloxy, aryloxycarbonyloxy, carboxylate, alkylcarbonyl, arylcarbonyl, alkoxycarbonyl, aminocarbonyl, alkylaminocarbonyl, dialkylaminocarbonyl, alkylthiocarbonyl, alkoxyl, phosphate, phosphonato, phosphinato, cyano, amino (including alkyl amino, dialkylamino, arylamino, diarylamino, and alkylarylamino), acylamino (including alkylcarbonylamino, arylcarbonylamino, carbamoyl and ureido), imino, sulfhydryl, alkylthio, arylthio, thiocarboxylate, sulfates, alkylsulfinyl, sulfonates, sulfamoyl, sulfonamido, nitro, trifluoromethyl, cyano, azido, heterocyclic, alkylaryl, or aromatic (including hetero aromatic) groups.

In some embodiments, substituted alkyls can include a heterocyclic group. As used herein, the term "heterocyclic group" includes closed ring structures analogous to carbocyclic groups in which one or more of the carbon atoms in the ring is an element other than carbon, for example, nitrogen, sulfur or oxygen. Heterocyclic groups may be saturated or unsaturated. Exemplary heterocyclic groups include, but are not limited to, aziridine, ethylene oxide (epoxides, oxiranes), thiirane (episulfides), dioxirane, azetidine, oxetane, thietane, dioxetane, dithietane, dithiete, azolidine, pyrrolidine, pyrroline, oxolane, dihydrofuran, and furan.

As used herein, the term "cleaning" refers to a method used to facilitate or aid in soil removal, bleaching, microbial population reduction, and any combination thereof. As used herein, the term "microorganism" refers to any noncellular or unicellular (including colonial) organism. Microorganisms include all prokaryotes. Microorganisms include bacteria (including cyanobacteria), spores, lichens, fungi, protozoa, virinos, viroids, viruses, phages, and some algae. As used herein, the term "microbe" is synonymous with microorganism. For the purpose of this patent application, successful microbial reduction is achieved when the microbial populations are reduced by at least about 50%, or by significantly more than is achieved by a wash with water. Larger reductions in microbial population provide greater levels of protection.

The term "hard surface" refers to a solid, substantially non-flexible surface such as a counter top, tile, floor, wall, panel, window, plumbing fixture, kitchen and bathroom furniture, appliance, engine, circuit board, and dish. Hard surfaces may include for example, health care surfaces and food processing surfaces. As used herein, the phrase "food processing surface" refers to a surface of a tool, a machine, equipment, a structure, a building, or the like that is employed as part of a food processing, preparation, or storage activity. Examples of food processing surfaces include surfaces of food processing or preparation equipment (e.g., slicing, canning, or transport equipment, including flumes), of food processing wares (e.g., utensils, dishware, wash ware, and bar glasses), and of floors, walls, or fixtures of structures in which food processing occurs. Food processing surfaces are found and employed in food anti-spoilage air circulation systems, aseptic packaging sanitizing, food refrigeration and cooler cleaners and sanitizers, ware washing sanitizing, blancher cleaning and sanitizing, food packaging materials, cutting board additives, third-sink sanitizing, beverage chillers and warmers, meat chilling or scalding waters, autodish sanitizers, sanitizing gels, cooling towers, food processing antimicrobial garment sprays, and non-to-low-aqueous food preparation lubricants, oils, and rinse additives.

As used herein, the phrase "health care surface" refers to a surface of an instrument, a device, a cart, a cage, furniture, a structure, a building, or the like that is employed as part of a health care activity. Examples of health care surfaces include surfaces of medical or dental instruments, of medical or dental devices, of electronic apparatus employed for monitoring patient health, and of floors, walls, or fixtures of structures in which health care occurs. Health care surfaces are found in hospital, surgical, infirmity, birthing, mortuary, and clinical diagnosis rooms. These surfaces can be those typified as "hard surfaces" (such as walls, floors, bed-pans, etc.), or fabric surfaces, e.g., knit, woven, and non-woven surfaces (such as surgical garments, draperies, bed linens, bandages, etc.), or patient-care equipment (such as respirators, diagnostic equipment, shunts, body scopes, wheel chairs, beds, etc.), or surgical and diagnostic equipment. Health care surfaces include articles and surfaces employed in animal health care.

The term "hydrotrope" means a material used in a composition to maintain a single phase neat or aqueous composition or solubilisate (liquid solution). Such hydrotrope may also be used in aspects of embodiments and/or embodiments of the present invention. Hydrotropy is a property that relates to the ability of a material to improve the solubility or miscibility of a substance in liquid phases in which the substance tends to be insoluble. Without being limited to a particular theory of the invention, a hydrotrope modifies a formulation to increase the solubility of an insoluble substance or creates micellar or mixed micellar structures resulting in a stable suspension of the insoluble substance.

As used herein, the term "laundry" refers to items or articles that are cleaned in a laundry washing machine. In general, laundry refers to any item or article made from or including textile materials, woven fabrics, non-woven fabrics, and knitted fabrics. The textile materials can include natural or synthetic fibers such as silk fibers, linen fibers, cotton fibers, polyester fibers, polyamide fibers such as nylon, acrylic fibers, acetate fibers, and blends thereof including cotton and polyester blends. The fibers can be treated or untreated. Exemplary treated fibers include those treated for flame retardancy. It should be understood that the term "linen" is often used to describe certain types of laundry items including bed sheets, pillow cases, towels, table linen, table cloth, bar mops and uniforms. The invention additionally provides a composition and method for treating non-laundry articles and surfaces including hard surfaces such as dishes, glasses, and other ware.

The term "microemulsion" as used herein, refers to a thermodynamically stable liquid dispersion of one liquid phase into another that is stabilized by an interfacial film of surfactant. According to the invention, the aqueous compositions are not microemulsions, as they lack an oily droplet and/or other component to be dispersed within another phase. The aqueous compositions according to the present invention can be characterized as either solutions or dispersions of surfactants in an aqueous system, such as water. However, according to the invention, when an oily soil is treated according to the methods of the invention a microemulsion is formed between the aqueous composition and the oily soil.

As used herein, the terms "alkyl phenol ethoxylate (or APE)-free" or "nonyl phenol ethoxylate (or NPE)-free" refers to a composition, mixture, or ingredients that do not contain alkyl phenol ethoxylates (specifically including nonyl phenol ethoxylates) or phenol-containing compounds or to which the same has not been added. Should alkyl phenol ethoxylates or -alkyl phenol ethoxylate containing compound be present through contamination of a composition, mixture, or ingredients, the amount of the same shall be less than 0.5 wt-%. In another embodiment, the amount of is less than 0.1 wt-% and in yet another embodiment, the amount is less than 0.01 wt-%. According to the invention, the compositions are both APE-free and specifically NPE-free.

As used herein, the term "soil" or "stain" refers to a non-polar oily (hydrophobic, water-insoluble) substance which may or may not contain particulate matter such as mineral clays, sand, natural mineral matter, carbon black, graphite, kaolin, environmental dust, etc.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both. As used herein, the term "cleaning performance" may be measured in terms of percentage of soil removal. In an aspect of the invention, the aqueous compositions according to the invention provide at least substantially similar cleaning performance to conventional APE-containing surfactant blends. Beneficially, in some aspects, the aqueous compositions according to the invention provide superior cleaning performance to conventional APE-containing surfactant blends.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods and compositions of the present invention may comprise, consist essentially of, or consist of the components and ingredients of the present invention as well as other ingredients described herein. As used herein, "consisting essentially of" means that the methods and compositions may include additional steps, components or ingredients, but only if the additional steps, components or ingredients do not materially alter the basic and novel characteristics of the claimed methods and compositions.

While an understanding of the mechanism is not necessary to practice the present invention and while the present invention is not limited to any particular mechanism of action, it is contemplated that, in some embodiments, the combination of a linear and branched fatty alcohol ethoxylates, and an ethoxylate propoxylate block copolymer provides at least substantially similar cleaning efficacy to NPE-containing detergents. Beneficially, however, the compositions are free of alkyl phenol ethoxylates (APEs), including nonyl phenol ethoxylates (NPEs), while providing effective cleaning for various soils, including oily and greasy soils, providing enhanced cleaning efficacy over commercially-available neutral, NPE-free cleaning compositions. Thus, the cleaning compositions provide a green, biodegradable replacement for conventional detergent surfactants. The cleaning compositions can be used in various industries, including, but not limited to: textile care or other laundering applications, and other hard-surface cleaning applications, including, for example: bathroom surfaces, dishwashing equipment, food and beverage equipment, vehicles and tabletops.

Cleaning Compositions

According to an embodiment of the invention the compositions comprise, consist of and/or consist essentially of a combination of both linear and branched fatty alcohol ethoxylates, and an ethoxylate propoxylate block copolymer. The compositions may further comprise, consist of and/or consist essentially of a linear fatty alcohol ethoxylate, a branched fatty alcohol ethoxylate, an ethoxylate propoxylate block copolymer, and water. Still further, the compositions may comprise, consist of and/or consist essentially of a linear and a branched fatty alcohol ethoxylate, an ethoxylate propoxylate block copolymer, water, and additional stabilizers and/or solvents. The compositions may optionally include additional functional ingredients.

The compositions according to the invention have an approximately neutral pH. In an aspect of the invention the pH of the compositions is between about 6-9, preferably between about 6-8.5, more preferably between about 7-8. In a further aspect, the pH of the neutral cleaning composition is about 7. As disclosed herein, the compositions may be further combined with detergency boosters, which are known to increase the pH, to provide additional cleaning efficacy.

The compositions provide significant utility for use as both laundry emulsifiers and hard surface cleaners. The liquid compositions (also referred to herein as aqueous compositions) are particularly suitable for use as a dilutable detergent or hard surface concentrate or as a ready-to-use product. According to the invention, a concentrate refers to a composition that is intended to be further diluted with water to provide a use solution. A use solution refers to an aqueous composition that can be applied to surfaces to provide detersive activity. In general, a use solution can have a solids content of less than about 90 wt-%, whereas the solids content refers to the weight percent of non-water components.

The compositions are dissolved in water to form a stable solution or surfactant dispersion. Additional stabilizing agents may be employed to improve phase stability of the compositions as disclosed herein. Beneficially the stabilized compositions of the invention avoid the issues with phase separation during storage. The compositions according to the invention may be provided in various forms for providing detersive compositions for use according to the methods of the invention. In an aspect of the invention, the compositions are provided as a liquid. The compositions may be dispensed from single or multi-use packaging in the various physical forms.

Non-Ionic Surfactant Blends

The compositions of the invention combine nonionic surfactants to provide effective detergency for use in laundry applications as emulsifiers to remove heavy soils and stains and/or in cleaning other soils as a hard surface cleaner. In aspects of the invention, the nonionic surfactants include the use of various nonionic surfactants. In aspects of the invention, the nonionic surfactants include the use of various dispersible, nonionic surfactants. In aspects of the invention, the surfactants include both linear and branched fatty alcohol ethoxylates (including e.g. Guerbet alcohol ethoxylates as the branched fatty alcohol ethoxylates) and polyethoxylene-polypropoxylene copolymers.

Beneficially, the surfactant blend preferably operates without substantial amounts of conventional solvents which are typical in pretreatment compositions used to soften, dissolve and/or otherwise pre-treat or pre-spot soils. The presence of the surfactant blend in a pre-treated soil according to the invention renders the soils uniquely subject to cleaning and substantially complete removal in laundering methods disclosed according to the methods of the present invention. Thus, the oily soils are being emulsified, which makes them dispersible in the wash liquor.

Linear Alcohol Ethoxylates

The compositions of the invention include a linear alcohol ethoxylate nonionic surfactant. As used herein, the linear alcohol ethoxylate is preferably a fatty alcohol ethoxylate. In additional aspects, the alcohol ethoxylate is a branched alcohol ethoxylate.

The ethoxylated $C_6$-$C_{18}$ fatty alcohols and $C_6$-$C_{18}$ mixed ethoxylated and propoxylated fatty alcohols are suitable surfactants for use in the present compositions. Suitable ethoxylated fatty alcohols include the $C_6$-$C_{18}$ ethoxylated fatty alcohols with a degree of ethoxylation from at least about 3 to 50. Particularly suitable ethoxylated fatty alcohols include $C_6$-$C_{18}$, preferably $C_{12}$-$C_{18}$, preferably $C_{12}$-$C_{16}$ and/or $C_{13}$-$C_{15}$, which may vary depending upon either the organic or synthetic source of the ethoxylated fatty alcohols.

Suitable ethoxylated fatty alcohols further include a degree of ethoxylation from at least about 3 or greater, preferably at least about 4 or greater. Preferably the degree of ethoxylation of the ethoxylated fatty alcohols according to the invention is from between 4 to 10. In addition, without being limited according to the invention, all ranges of the degree of ethoxylation recited are inclusive of the numbers defining the range and include each integer within the defined range. For example, commercially available ethoxylated $C_{13}$-$C_{15}$ fatty alcohols have a degree of ethoxylation of 7 (e.g. 7 moles of EO) and has a predominately unbranched $C_{13}$-$C_{15}$ oxo alcohol having approximately 67% $C_{13}$ and approximately 33% $C_{15}$. As one skilled in the art appreciates, additional synthetic and organic ethoxylated fatty alcohols are available and included within the scope of the present invention.

In an aspect, the compositions include from about 0.1 wt-%-80 wt-% linear alcohol ethoxylate surfactant, from about 1 wt-%-50 wt-% linear alcohol ethoxylate surfactant, from about 10 wt-%-50 wt-% linear alcohol ethoxylate surfactant, preferably from about 15 wt-%-40 wt-% linear alcohol ethoxylate surfactant. The linear alcohol ethoxylate surfactant is included in the compositions in an amount effective to provide detersive properties for effective cleaning. An effective amount should be considered as an amount that provides a concentrate of the cleaning composition the optional detersive property. In addition, without being limited according to the invention, all ranges recited are inclusive of the numbers defining the range and include each integer within the defined range.

Branched Alcohol Ethoxylates

The compositions of the invention also include a branched alcohol ethoxylate nonionic surfactant. Preferably, the compositions of the invention include a Guerbet alcohol ethoxylate or a Guerbet ethoxylate as the branched alcohol ethoxylate nonionic surfactant. Additional description of branched alcohol ethoxylate and alkoxylate surfactants is set forth in U.S. Pat. No. 7,530,361 titled "Detergent Composition Containing Branched Alcohol Alkoxylate and Compatibilizing Surfactant, and Method for Using," which is herein incorporated by reference in its entirety.

Preferred branched alcohol ethoxylates include Guerbet ethoxylates, which may also be referred to as Guerbet alcohol ethoxylates. Guerbet alcohol ethoxylates may also be referred to as alkyl polyethylene glycols and/or alkyl polyethylene glycol ethers Guerbet ethoxylates suitable for use according to the invention have the following formula:

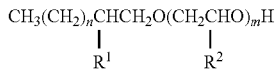

In an aspect of the invention the Guerbet ethoxylate is further defined wherein R1 is C2-C20 alkyl and R2 is H or C1-C4 alkyl. In a further aspect of the invention, the Guerbet ethoxylate is defined wherein "n" is an integer between 2 and 20 and wherein "m" is an integer between 1 and 40.

Guerbet alcohol ethoxylates suitable for use according to the invention have the following formula:

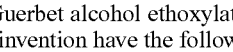

In an aspect of the invention the Guerbet alcohol ethoxylate is further defined wherein R1 is a branched C2-C20 alkyl group and n is from 2 to 20. In an aspect of the invention the Guerbet alcohol ethoxylate is a C2-C10 Guerbet alcohol ethoxylate, preferably a C6-C10 Guerbet alcohol ethoxylate, wherein the carbon chain may be Y-shaped and have the ethoxylated end at the bottom of the Y.

In an aspect of the invention, the branched alcohol ethoxylate is a Guerbet alcohol ethoxylate that is prepared from a Guerbet alcohol by dimerization of alkenes (e.g. butane). In an additional aspect of the invention, the Guerbet alcohol ethoxylate can be reacted in a self-condensation of alcohols by which alcohols having branched alkyl chains are produced. The reaction sequence is related to the Aldol condensation and occurs at high temperatures under catalytic conditions. The product is a branched alcohol with twice the molecular weight of the reactant minus a mole of water. The reaction proceeds by a number of sequential reaction steps. At first the alcohol is oxidized to an aldehyde. Then Aldol condensation takes place after proton extraction. Thereafter the aldol product is dehydrated and the hydrogenation of the allylic aldehyde takes place. These products are called Guerbet alcohols and are further reacted to the non-ionic alkoxylated Guerbet alcohols by alkoxylation with i.e. ethylene oxide or propylene oxide. The ethoxylated Guerbet alcohols have a lower solubility in water compared to the linear ethoxylated alcohols with the same number of carbon atoms. Therefore the exchange of linear fatty alcohols by branched fatty alcohols makes it necessary to use good solubilizers which are able to keep the Guerbet alcohol in solution and the resulting emulsion stable even over a longer storage time. According to the invention, this is achieved through the combination with additional nonionic surfactants and optional stabilizing agents (e.g. glycols, such as alkylene glycols including propylene glycol and an alcohol, such as an isopropyl alcohol).

The branched alcohol alkoxylates, including Guerbet alcohol ethoxylates, can be prepared according to the methods disclosed for example in U.S. Pat. Nos. 6,906,320, 6,737,553 and 5,977,048, the disclosure of these patents are herein incorporated by reference in their entirety. Exemplary branched Guerbet alcohol ethoxylates include those available under the tradenames Lutensol XP-40 and Lutensol XP-50 (BASF Corporation). In general, Lutensol XP-40 can be considered to have 4 repeating ethoxy groups (i.e. 4 moles EO), and Lutensol XP-50 can be considered to have 5 repeating ethoxy groups (i.e. 5 moles EO).

The branched alcohol alkoxylates, including Guerbet alcohol ethoxylates, can be prepared according to the methods disclosed for example in U.S. Pat. Nos. 6,906,320, 6,737,553 and 5,977,048, the disclosure of these patents are herein incorporated by reference in their entirety. Exemplary branched Guerbet alcohol ethoxylates include those available under the tradenames Lutensol XP-40 and Lutensol XP-50 (BASF Corporation). In general, Lutensol XP-40 can be considered to have 4 repeating ethoxy groups (i.e. 4 moles EO), and Lutensol XP-50 can be considered to have 5 repeating ethoxy groups (i.e. 4 moles EO).

Branched alcohol ethoxylates or alkoxylates can be classified as relatively water insoluble or relatively water soluble. In general, a water insoluble branched alcohol ethoxylate can be considered an ethoxylate that, when provided as a composition containing 5 wt-% of the branched alcohol ethoxylate and 95 wt-% water, has a tendency to deposit on a surface and form a greasy film. Lutensol XP-40 and Lutensol XP-50 from BASF Corporation are examples of water-insoluble branched alcohol ethoxylates.

According to an embodiment of the invention a branched alcohol ethoxylate or alkoxylate, preferably a water-insoluble Guerbet alcohol ethoxylate has from about 10 wt-% to about 90 wt-% ethylene oxide, from about 20 wt-% to about 70 wt-% ethylene oxide preferably from about 30 wt-% to about 60 wt-% ethylene oxide. According to a further embodiment of the invention, the alcohol ethoxylate or alkoxylate (e.g. Guerbet alcohol ethoxylate) has at least 4 moles ethylene oxide, at least 5 moles ethylene oxide, or greater.

In an aspect, the compositions include from about 0.1 wt-%-80 wt-% Guerbet alcohol ethoxylate surfactant, from about 0.1 wt-%-75 wt-% Guerbet alcohol ethoxylate surfactant, from about 1 wt-%-50 wt-% Guerbet alcohol ethoxylate surfactant, from about 10 wt-%-40 wt-% Guerbet alcohol ethoxylate surfactant, preferably from about 15 wt-%-30 wt-% Guerbet alcohol ethoxylate surfactant. The branched fatty alcohol ethoxylate, such as the preferred Guerbet alcohol ethoxylate surfactant, is included in the compositions in an amount effective to provide detersive properties for effective cleaning. An effective amount should be considered as an amount that provides a concentrate of the cleaning composition the optional detersive property. In addition, without being limited according to the invention, all ranges recited are inclusive of the numbers defining the range and include each integer within the defined range.

Ethylene Oxide-Propylene Oxide Copolymers

The compositions of the invention include an ethylene oxide-propylene oxide copolymer. Preferably, the compositions of the invention include water-insoluble, ethylene oxide/propylene oxide block copolymers. Ethylene oxide-propylene oxide copolymers may also be referred to as ethoxylate propoxylate block copolymers, polyethoxylene-polypropoxylene copolymer, and/or EP-PO copolymers.

The ethylene oxide/propylene oxide block copolymers as disclosed herein also include reverse ethylene oxide/propylene oxide copolymers. A combination of various traditional and/or reverse ethylene oxide/propylene oxide copolymers may also be employed in the neutral cleaning compositions of the invention. In an aspect of the invention, the ethylene oxide/propylene oxide block copolymer is a reverse EO-PO copolymer. In a further preferred aspect of the invention, the ethylene oxide/propylene oxide block copolymer has a molecular weight less than about 10,000. Still further, in a preferred aspect of the invention, the ethylene oxide/propylene oxide block copolymer has water solubility less than about 1%.

Commercially-available ethylene oxide/propylene oxide block copolymers include but are not limited to, PLURONIC® and TETRONIC® products (BASF Corporation) and SURFONIC® products (Huntsman Corporation). These exemplary products are polymeric compounds made from a sequential propoxylation and ethoxylation of initiator. Pluronic® compounds are difunctional (two reactive hydrogens)

compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule.

In an aspect, the compositions include from about 0.1 wt-%-80 wt-% ethylene oxide/propylene oxide block copolymer surfactant, from about 0.1 wt-%-50 wt-% ethylene oxide/propylene oxide block copolymer surfactant, from about 1 wt-%-50 wt-% ethylene oxide/propylene oxide block copolymer surfactant, from about 10 wt-%-50 wt-% ethylene oxide/propylene oxide block copolymer surfactant, preferably from about 20 wt-%-40 wt-% ethylene oxide/propylene oxide block copolymer surfactant. The ethylene oxide/propylene oxide block copolymer surfactant is included in the compositions in an amount effective to provide detersive properties for effective cleaning. An effective amount should be considered as an amount that provides a concentrate of the cleaning composition the optional detersive property. In addition, without being limited according to the invention, all ranges recited are inclusive of the numbers defining the range and include each integer within the defined range.

Stabilizing Agents

A stabilizing agent, including a carrier and/or solvent, may be included in the compositions to improve phase stability of the compositions. In a preferred aspect, solvents for enhanced soil removal properties are not required in the compositions, and preferably are not included. Therefore, according to an embodiment solvents and/or carriers (referred to herein as stabilizing agents) for phase stability which do not substantially contribute to soil removal may be included. The cleaning compositions of the invention may include a stabilizing agent to adjust the viscosity of the final composition. The intended final use of the composition may determine whether or not a stabilizing agent is included in the cleaning composition. If a stabilizing agent is included in the cleaning composition, it is usually a low cost solvent such as isopropyl alcohol and/or propylene glycol. According to the invention solvent may or may not be included to improve soil removal, handleability or ease of use of the compositions of the invention.

In some embodiments, the carrier includes primarily water. The carrier can include or be primarily an organic solvent, such as simple alkyl alcohols, e.g., ethanol, isopropanol, n-propanol, benzyl alcohol, and the like. Polyols are also useful carriers, including glycerol, sorbitol, and the like.

Suitable stabilizing agents include, but are not limited to: glycol ethers. Suitable glycol ethers include diethylene glycol n-butyl ether, diethylene glycol n-propyl ether, diethylene glycol ethyl ether, diethylene glycol methyl ether, diethylene glycol t-butyl ether, dipropylene glycol n-butyl ether, dipropylene glycol methyl ether, dipropylene glycol ethyl ether, dipropylene glycol propyl ether, dipropylene glycol tert-butyl ether, ethylene glycol butyl ether, ethylene glycol propyl ether, ethylene glycol ethyl ether, ethylene glycol methyl ether, ethylene glycol methyl ether acetate, propylene glycol n-butyl ether, propylene glycol ethyl ether, propylene glycol methyl ether, propylene glycol n-propyl ether, tripropylene glycol methyl ether and tripropylene glycol n-butyl ether, ethylene glycol phenyl ether (commercially available as DOWANOL EPH™ from Dow Chemical Co.), propylene glycol phenyl ether (commercially available as DOWANOL PPH™ from Dow Chemical Co.), and the like, or mixtures thereof.

Additional suitable commercially available glycol ethers (all of which are available from Union Carbide Corp.) include Butoxyethyl PROPASOL™, Butyl CARBITOL™ acetate, Butyl CARBITOL™, Butyl CELLOSOLVE™ acetate, Butyl CELLOSOLVE™, Butyl DIPROPASOL™, Butyl PROPASOL™, CARBITOL™ PM-600, CARBITOL™ Low Gravity, CELLOSOLVE™ acetate, CELLOSOLVE™, Ester EEP™, FILMER IBT™, Hexyl CARBITOL™, Hexyl CELLOSOLVE™, Methyl CARBITOL™, Methyl CELLOSOLVE™ acetate, Methyl CELLOSOLVE™, Methyl DIPROPASOL™, Methyl PROPASOL™ acetate, Methyl PROPASOL™, Propyl CARBITOL™, Propyl CELLOSOLVE™, Propyl DIPROPASOL™ and Propyl PROPASOL™.

In an aspect, the compositions include from about 0 wt-%-20 wt-% stabilizing agent(s), from about 0.1 wt-%-15 wt-% stabilizing agent(s), from about 1 wt-%-15 wt-% stabilizing agent(s), preferably from about 5 wt-%-10 wt-% stabilizing agent(s). In addition, without being limited according to the invention, all ranges recited are inclusive of the numbers defining the range and include each integer within the defined range.

Water

In some embodiments, the compositions of the present invention include a source of water. The composition may include water provided as deionized water or as softened water. The water provided as part of the concentrate can be relatively free of hardness. It is expected that the water can be deionized to remove a portion of the dissolved solids. That is, the concentrate can be formulated with water that includes dissolved solids, and can be formulated with water that can be characterized as hard water.

In certain embodiments, the present composition of a concentrated liquid composition includes about 0.1 to about 80 wt-% water, about 1 to about 80 wt-% water, about 5 to about 50 wt-% water, or about 5 to about 20 wt-% water. It is to be understood that all values and ranges between these values and ranges are encompassed by the present invention.

Additional Functional Ingredients

The components of the composition can further be combined with various functional components suitable for use in laundry and other hard surface cleaning applications. In some embodiments, the emulsifying compositions and/or hard surface cleaning compositions include the fatty alcohol ethoxylate, alkyl polyethylene glycol and ethoxylate propoxylate block copolymer, which make up a large amount, or even substantially all of the total weight of the emulsifying compositions. For example, in some embodiments few or no additional functional ingredients are disposed therein.

In other embodiments, additional functional ingredients may be included in the compositions. The functional ingredients provide desired properties and functionalities to the compositions. For the purpose of this application, the term "functional ingredient" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional ingredients may be used. For example, many of the functional materials discussed below relate to materials used in laundry cleaning. However, other embodiments may include functional ingredients for use in other applications.

In preferred embodiments, the compositions do not include solvents contributing to soil removal. In further preferred embodiments, the compositions do not include hydrotropes, couplers, sequestrants and/or chelating agents. In preferred embodiments, the compositions used for a pre-wash or pre-soak application do not include additional surfactants, other than the blend of nonionic surfactants disclosed herein.

In other embodiments, the compositions may include optical brighteners, solubility modifiers, dispersants, stabilizing agents, additional surfactants, fragrances and/or dyes, rheology modifiers or thickeners/gelling agents, enzymes, enzyme stabilizing agents, carriers, buffers, solvents and the like.

Optical Brighteners

In some embodiments, an optical brightener component may also be present in the compositions of the present invention. The optical brightener can include any brightener that is capable of eliminating graying and yellowing of fabrics. Typically, these substances attach to the fibers and bring about a brightening and simulated bleaching action by converting invisible ultraviolet radiation into visible longer-wave length light, the ultraviolet light absorbed from sunlight being irradiated as a pale bluish fluorescence and, together with the yellow shade of the grayed or yellowed laundry, producing pure white.

Fluorescent compounds belonging to the optical brightener family are typically aromatic or aromatic heterocyclic materials often containing condensed ring systems. An important feature of these compounds is the presence of an uninterrupted chain of conjugated double bonds associated with an aromatic ring. The number of such conjugated double bonds is dependent on substituents as well as the planarity of the fluorescent part of the molecule. Most brightener compounds are derivatives of stilbene or 4,4'-diamino stilbene, biphenyl, five membered heterocycles (triazoles, oxazoles, imidazoles, etc.) or six membered heterocycles (cumarins, naphthalamides, triazines, etc.).

Optical brighteners useful in the present invention are known and commercially available. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles and other miscellaneous agents. Examples of these types of brighteners are disclosed in "The Production and Application of Fluorescent Brightening Agents", M. Zahradnik, Published by John Wiley & Sons, New York (1982), the disclosure of which is incorporated herein by reference.

Stilbene derivatives which may be useful in the present invention include, but are not necessarily limited to, derivatives of bis(triazinyl)amino-stilbene; bisacylamino derivatives of stilbene; triazole derivatives of stilbene; oxadiazole derivatives of stilbene; oxazole derivatives of stilbene; and styryl derivatives of stilbene. In an embodiment, optical brighteners include stilbene derivatives. Additional optical brighteners for use in the present invention include, but are not limited to, the classes of substance of 4,4'-diamino-2,2'-stilbenedisulfonic acids (flavonic acids), 4,4'-distyrylbiphenyls, methylumbelliferones, coumarins, dihydroquinolinones, 1,3-diarylpyrazolines, naphthalimides, benzoxazol, benzisoxazol and benzimidazol systems, and pyrene derivatives substituted by heterocycles, and the like. Suitable optical brightener levels include from about 0.01% by weight to about 1% by weight, preferably from about 0.05% by weight to about 0.1% by weight, and more preferably from about 0.1% by weight to about 0.5% by weight.

Dye or Odorant

Various dyes, odorants including perfumes, and other aesthetic enhancing agents may also be included in the compositions. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like. Fragrances or perfumes that may be included in the compositions include, for example, terpenoids such as citronellol, aldehydes such as amyl cinnamaldehyde, a jasmine such as ClS-jasmine orjasmal, vanillin, and the like.

Enzymes

The compositions can comprise one or more enzymes which provide cleaning performance and/or fabric care benefits. Enzymes can be included herein for a wide variety of fabric laundering purposes, including removal of protein-based, carbohydrate-based, or triglyceride-based stains, for example, and/or for fabric restoration. Examples of suitable enzymes include, but are not limited to, hemicellulases, peroxidases, proteases, cellulases, xylanases, lipases, phospholipases, esterases, cutinases, pectinases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, amylases, or combinations thereof and may be of any suitable origin. The choice of enzyme(s) takes into account factors such as pH-activity, stability optima, thermostability, stability versus active detergents, chelants, builders, etc. Exemplary description of detersive enzymes suitable for use herein is provided in U.S. Pat. Nos. 4,261,868, 4,435,307 and 6,579,839, EP 130756, WO 91/06637, WO 94/02597, WO 95/10591, WO 96/23873, WO 99/20726 and WO 02/099091, each of which are herein incorporated by reference in its entirety.

Solvents

The compositions can comprise one or more solvents which provide cleaning performance and/or enhanced soil removal. Suitable solvents agents include, but are not limited to: oxygenated solvents such as lower alkanols, lower alkyl ethers, glycols, aryl glycol ethers and lower alkyl glycol ethers. Examples of other solvents include, but are not limited to: methanol, ethanol, propanol, isopropanol and butanol, isobutanol, ethylene glycol, diethylene glycol, triethylene glycol, propylene glycol, dipropylene glycol, mixed ethylene-propylene glycol ethers, ethylene glycol phenyl ether, and propylene glycol phenyl ether. Substantially water soluble glycol ether solvents include, not are not limited to: propylene glycol methyl ether, propylene glycol propyl ether, dipropylene glycol methyl ether, tripropylene glycol methyl ether, ethylene glycol butyl ether, diethylene glycol methyl ether, diethylene glycol butyl ether, ethylene glycol dimethyl ether, ethylene glycol propyl ether, diethylene glycol ethyl ether, triethylene glycol methyl ether, triethylene glycol ethyl ether, triethylene glycol butyl ether and the like.

Additional Surfactants

In some embodiments, the compositions of the present invention include additional surfactants. The cleaning composition, may include and/or be used in combination with additional surfactants, including co-surfactants that are either nonionic surfactants and/or anionic or other surfactant classes. In some embodiments, the additional surfactants may be included in amounts from about 0.1 wt-% or more, or from about 1 wt-% or more. In still yet other embodiments, the compositions of the present invention include about 10 ppm to about 1000 ppm of an additional surfactant. It is to be understood that all values and ranges between these values and ranges are encompassed by the present invention.

Nonionic Surfactants

Useful nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants include:

Condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Neodol™ manufactured by Shell Chemical Co. and Alfonic™ manufactured by Vista Chemical Co.

Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Nopalcol™ manufactured by Henkel Corporation and Lipopeg™ manufactured by Lipo Chemicals, Inc. In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention for specialized embodiments, particularly indirect food additive applications. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions of the present invention containing amylase and/or lipase enzymes because of potential incompatibility.

Examples of nonionic low foaming surfactants include:

Nonionic compounds which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from about 1,000 to about 3,100 with the central hydrophile including 10% by weight to about 80% by weight of the final molecule. These reverse Pluronics™ are manufactured by BASF Corporation under the trade name Pluronic™ R surfactants. Likewise, the Tetronic™ R surfactants are produced by BASF Corporation by the sequential addition of ethylene oxide and propylene oxide to ethylenediamine. The hydrophobic portion of the molecule weighs from about 2,100 to about 6,700 with the central hydrophile including 10% by weight to 80% by weight of the final molecule.

Nonionic compounds which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

The alkylphenoxypolyethoxyalkanols of U.S. Pat. No. 2,903,486 issued Sep. 8, 1959 to Brown et al. and represented by the formula

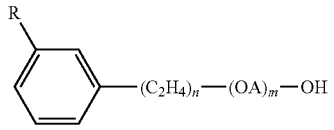

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkaline oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n\ (C_2H_4O)_mH$ wherein Y is the residue of organic compound having from about 1 to 6 carbon atoms and one reactive hydrogen atom, n has an average value of at least about 6.4, as determined by hydroxyl number and m has a value such that the oxyethylene portion constitutes about 10% to about 90% by weight of the molecule.

The conjugated polyoxyalkylene compounds described in U.S. Pat. No. 2,674,619, issued Apr. 6, 1954 to Lundsted et al. having the formula $Y[(C_3H_6O_n\ (C_2H_4O)_mH]_x$ wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has value such that the oxyethylene content of the molecule is from about 10% to about 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_6O)_n(C_2H_4O)_mH]_x$ wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10% to about 90% by weight. In either case the oxypropylene chains may contain optionally, but advantageously, small amounts of ethylene oxide and the oxyethylene chains may contain also optionally, but advantageously, small amounts of propylene oxide.

Polyhydroxy fatty acid amide surfactants suitable for use in the present compositions include those having the structural formula $R_2CON_{R1}Z$ in which: R1 is H, $C_1$-$C_4$ hydrocarbyl, 2-hydroxy ethyl, 2-hydroxy propyl, ethoxy, propoxy group, or a mixture thereof; $R_2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

The alkyl ethoxylate condensation products of aliphatic alcohols with from about 0 to about 25 moles of ethylene oxide are suitable for use in the present compositions. The alkyl chain of the aliphatic alcohol can either be straight or branched, primary or secondary, and generally contains from 6 to 22 carbon atoms.

Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from about 6 to about 30 carbon atoms and a polysaccharide, e.g., a polyglycoside, hydrophilic group containing from about 1.3 to about 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Fatty acid amide surfactants suitable for use the present compositions include those having the formula: $R_6CON(R_7)_2$ in which $R_6$ is an alkyl group containing from 7 to 21 carbon atoms and each $R_7$ is independently hydrogen, $C_1$-$C_4$ alkyl, $C_1$-$C_4$ hydroxyalkyl, or —$(C_2H_4O)_xH$, where x is in the range of from 1 to 3.

A useful class of non-ionic surfactants includes the class defined as alkoxylated amines or, most particularly, alcohol alkoxylated/aminated/alkoxylated surfactants. These nonionic surfactants may be at least in part represented by the general formulae: $R^{20}$—$(PO)_sN$-$(EO)_tH$, $R^{20}$—$(PO)_sN$-$(EO)_tH(EO)_tH$, and $R^{20}$—$N(EO)_tH$; in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula: $R^{20}$—$(PO)_V$—$N[(EO)_wH][(EO)_zH]$ in which $R^{20}$ is as defined above, v is 1 to 20 (e.g., 1, 2, 3, or 4 (preferably 2)), and w and z are independently 1-10, preferably 2-5. These compounds are represented commercially by a line of products sold by Huntsman Chemicals as nonionic surfactants. A preferred chemical of this class includes Surfonic™ PEA 25 Amine Alkoxylate. Preferred nonionic surfactants for the compositions of the invention include alcohol alkoxylates, EO/PO block copolymers, alkylphenol alkoxylates, and the like.

The treatise *Nonionic Surfactants*, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and detergents" (Vol. I and II by Schwartz, Perry and Berch).

Semi-Polar Nonionic Surfactants

The semi-polar type of nonionic surface active agents is another class of nonionic surfactant useful in compositions of the present invention. Generally, semi-polar nonionics are high foamers and foam stabilizers, which can limit their application in CIP systems. However, within compositional embodiments of this invention designed for high foam cleaning methodology, semi-polar nonionics would have immediate utility. The semi-polar nonionic surfactants include the amine oxides, phosphine oxides, sulfoxides and their alkoxylated derivatives.

Amine oxides are tertiary amine oxides corresponding to the general formula:

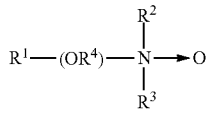

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to about 20.

Useful water soluble amine oxide surfactants are selected from the coconut or tallow alkyl di-(lower alkyl) amine oxides, specific examples of which are dodecyldimethylamine oxide, tridecyldimethylamine oxide, etradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

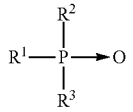

wherein the arrow is a conventional representation of a semi-polar bond; and, $R^1$ is an alkyl, alkenyl or hydroxyalkyl moiety ranging from 10 to about 24 carbon atoms in chain length; and, $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphone oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide.

Semi-polar nonionic surfactants useful herein also include the water soluble sulfoxide compounds which have the structure:

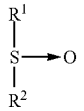

wherein the arrow is a conventional representation of a semi-polar bond; and, $R^1$ is an alkyl or hydroxyalkyl moiety of about 8 to about 28 carbon atoms, from 0 to about 5 ether linkages and from 0 to about 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Semi-polar nonionic surfactants for the compositions of the invention include dimethyl amine oxides, such as lauryl dimethyl amine oxide, myristyl dimethyl amine oxide, cetyl dimethyl amine oxide, combinations thereof, and the like. Useful water soluble amine oxide surfactants are selected from the octyl, decyl, dodecyl, isododecyl, coconut, or tallow alkyl di-(lower alkyl) amine oxides, specific examples of which are octyldimethylamine oxide, nonyldimethylamine oxide, decyldimethylamine oxide, undecyldimethylamine oxide, dodecyldimethylamine oxide, iso-dodecyldimethyl amine oxide, tridecyldimethylamine oxide, tetradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Suitable nonionic surfactants suitable for use with the compositions of the present invention include alkoxylated surfactants. Suitable alkoxylated surfactants include EO/PO copolymers, capped EO/PO copolymers, alcohol alkoxylates, capped alcohol alkoxylates, mixtures thereof, or the like. Suitable alkoxylated surfactants for use as solvents include EO/PO block copolymers, such as the Pluronic and reverse Pluronic surfactants; alcohol alkoxylates, such as Dehypon LS-54 ($R-(EO)_5(PO)_4$) and Dehypon LS-36 ($R-(EO)_3(PO)_6$); and capped alcohol alkoxylates, such as Plurafac LF221 and Tegoten EC11; mixtures thereof, or the like.

Anionic Surfactants

Also useful in the present invention are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility. As those skilled in the art understand, anionics are excellent detersive surfactants and are therefore favored additions to heavy duty detergent compositions.

Anionic sulfate surfactants suitable for use in the present compositions include alkyl ether sulfates, alkyl sulfates, the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside, and the like. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule).

Anionic sulfonate surfactants suitable for use in the present compositions also include alkyl sulfonates, the linear and branched primary and secondary alkyl sulfonates, and the aromatic sulfonates with or without substituents.

Anionic carboxylate surfactants suitable for use in the present compositions include carboxylic acids (and salts), such as alkanoic acids (and alkanoates), ester carboxylic acids (e.g. alkyl succinates), ether carboxylic acids, and the like. Such carboxylates include alkyl ethoxy carboxylates, alkyl aryl ethoxy carboxylates, alkyl polyethoxy polycarboxylate surfactants and soaps (e.g. alkyl carboxyls). Secondary carboxylates useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary carboxylate surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present. Suitable carboxylates also include acylamino acids (and salts), such as acylgluamates, acyl peptides, sarcosinates (e.g. N-acyl sarcosinates), taurates (e.g. N-acyl taurates and fatty acid amides of methyl tauride), and the like.

Suitable anionic surfactants include alkyl or alkylaryl ethoxy carboxylates of the following formula:

$$R—O—(CH_2CH_2O)_n(CH_2)_m—CO_2X \quad (3)$$

in which R is a $C_8$ to $C_{22}$ alkyl group or

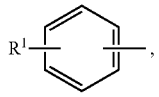

in which $R^1$ is a $C_4$-$C_{16}$ alkyl group; n is an integer of 1-20; m is an integer of 1-3; and X is a counter ion, such as hydrogen, sodium, potassium, lithium, ammonium, or an amine salt such as monoethanolamine, diethanolamine or triethanolamine. In some embodiments, n is an integer of 4 to 10 and m is 1. In some embodiments, R is a $C_8$-$C_{16}$ alkyl group. In some embodiments, R is a $C_{12}$-$C_{14}$ alkyl group, n is 4, and m is 1.

In other embodiments, R is

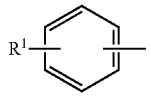

and $R^1$ is a $C_6$-$C_{12}$ alkyl group. In still yet other embodiments, $R^1$ is a $C_9$ alkyl group, n is 10 and m is 1.

Such alkyl and alkylaryl ethoxy carboxylates are commercially available. These ethoxy carboxylates are typically available as the acid forms, which can be readily converted to the anionic or salt form. Commercially available carboxylates include, Neodox 23-4, a $C_{12-13}$ alkyl polyethoxy (4) carboxylic acid (Shell Chemical), and Emcol CNP-110, a $C_9$ alkylaryl polyethoxy (10) carboxylic acid (Witco Chemical). Carboxylates are also available from Clariant, e.g. the product Sandopan® DTC, a $C_{13}$ alkyl polyethoxy (7) carboxylic acid.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure RnX+Y—and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

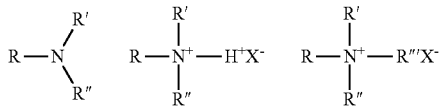

in which, R represents a long alkyl chain, R', R", and R'" may be either long alkyl chains or smaller alkyl or aryl groups or hydrogen and X represents an anion. The amine salts and quaternary ammonium compounds are preferred for practical use in this invention due to their high degree of water solubility.

The majority of large volume commercial cationic surfactants can be subdivided into four major classes and additional sub-groups known to those or skill in the art and described in "Surfactant Encyclopedia", *Cosmetics & Toiletries*, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Cationic surfactants useful in the compositions of the present invention include those having the formula $R^1{}_mR^2{}_xY_LZ$ wherein each $R^1$ is an organic group containing a straight or branched alkyl or alkenyl group optionally substituted with up to three phenyl or hydroxy groups and optionally interrupted by up to four of the following structures:

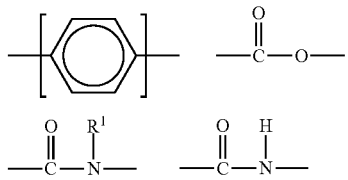

or an isomer or mixture of these structures, and which contains from about 8 to 22 carbon atoms. The $R^1$ groups can additionally contain up to 12 ethoxy groups. m is a number from 1 to 3. Preferably, no more than one $R^1$ group in a molecule has 16 or more carbon atoms when m is 2 or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group are filled by hydrogens. Y is can be a group including, but not limited to:

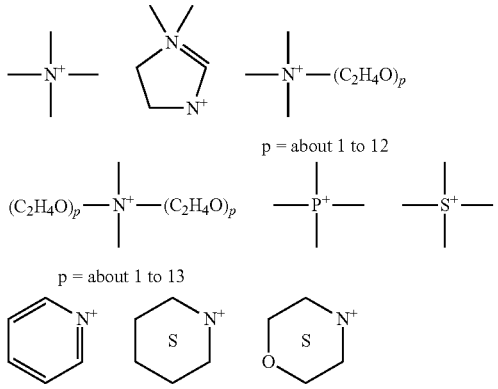

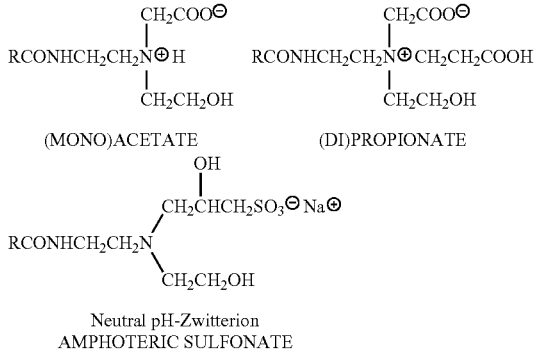

or a mixture thereof. Preferably, L is 1 or 2, with the Y groups being separated by a moiety selected from $R^1$ and $R^2$ analogs (preferably alkylene or alkenylene) having from 1 to about 22 carbon atoms and two free carbon single bonds when L is 2. Z is a water soluble anion, such as a halide, sulfate, methylsulfate, hydroxide, or nitrate anion, particularly preferred being chloride, bromide, iodide, sulfate or methyl sulfate anions, in a number to give electrical neutrality of the cationic component.

Amphoteric Surfactants

Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia" *Cosmetics & Toiletries*, Vol. 104 (2) 69-71 (1989), which is herein incorporated by reference in its entirety. The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives having application in the present invention generally have the general formula:

wherein R is an acyclic hydrophobic group containing from about 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Amphocarboxylic acids can be produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reaction $RNH_2$, in which $R{=}C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine Examples of commercial N-alkylamino acid ampholytes having application in this invention include alkyl beta-amino dipropionates, $RN(C_2H_4COOM)_2$ and $RNHC_2H_4COOM$. In an embodiment, R can be an acyclic hydrophobic group containing from about 8 to about 18 carbon atoms, and M is a cation to neutralize the charge of the anion.

Suitable amphoteric surfactants include those derived from coconut products such as coconut oil or coconut fatty acid. Additional suitable coconut derived surfactants include as part of their structure an ethylenediamine moiety, an alkanolamide moiety, an amino acid moiety, e.g., glycine, or a combination thereof; and an aliphatic substituent of from about 8 to 18 (e.g., 12) carbon atoms. Such a surfactant can also be considered an alkyl amphodicarboxylic acid. These amphoteric surfactants can include chemical structures represented as: $C_{12}$-alkyl-C(O)—NH—$CH_2$—$CH_2$—$N^+(CH_2—CH_2—CO_2Na)_2$—$CH_2$—$CH_2$—OH or $C_{12}$-alkyl-C(O)—N(H)—$CH_2$—$CH_2$—$N^+(CH_2—CO_2Na)_2$—$CH_2$—$CH_2$—OH. Disodium cocoampho dipropionate is one suitable amphoteric surfactant and is commercially available under the tradename Miranol™ FBS from Rhodia Inc., Cranbury, N.J. Another suitable coconut derived amphoteric surfactant with the chemical name disodium cocoampho diacetate is sold under the tradename Mirataine™ JCHA, also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). Each of these references are herein incorporated by reference in their entirety.

Zwitterionic Surfactants

Zwitterionic surfactants can be thought of as a subset of the amphoteric surfactants and can include an anionic charge. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate.

Betaine and sultaine surfactants are exemplary zwitterionic surfactants for use herein. A general formula for these compounds is:

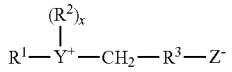

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

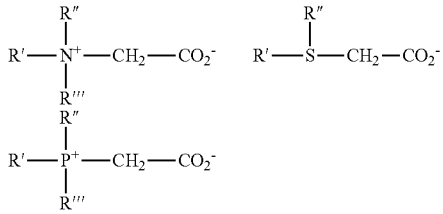

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present invention include those compounds having the formula $(R(R^1)_2N^+ R^2SO^-$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). Each of these references are herein incorporated in their entirety.

Embodiments

Exemplary ranges of the detergent compositions according to the invention are shown in Table 1 in weight percentage of the liquid detergent compositions. The compositions of the invention can be formed in a concentrated water-free, aqueous, or a thickened aqueous liquid concentrate for use in forming a use composition.

TABLE 1

| Material | First Exemplary Range wt-% | Second Exemplary Range wt-% | Third Exemplary Range wt-% | Fourth Exemplary Range wt-% |
|---|---|---|---|---|
| Linear Alcohol Ethoxylate | 0.1-50 | 1-50 | 10-50 | 15-40 |
| Branched Alcohol Ethoxylate (e.g. Guerbet alcohol ethoxylate) | 0.1-50 | 1-50 | 10-40 | 15-30 |
| Ethylene Oxide/Propylene Oxide Block Copolymer | 0.1-50 | 1-50 | 10-50 | 20-40 |
| Stabilizing Agents | 0-20 | 0.1-15 | 1-15 | 5-10 |
| Water | 0-80 | 0.1-80 | 1-50 | 5-20 |
| Additional Functional Ingredients | 0-50 | 0-30 | 0-20 | 0-10 |

In some aspects the nonionic surfactant blends are in a ratio of linear alcohol ethoxylate to branched alcohol ethoxylate (e.g. Guerbet alcohol ethoxylate) to EO-PO copolymer from about 1:1:1 to about 10:1:10, from about 1:1:1 to about 7.5:

1:5 preferably from about 1:1:1 to about 2:1:2. In addition, without being limited according to the invention, all ranges for the ratios recited are inclusive of the numbers defining the range and include each integer within the defined range of ratios.

The detergent compositions may include concentrate compositions or may be diluted to form use compositions. In general, a concentrate refers to a composition that is intended to be diluted with water to provide a use solution that contacts an object to provide the desired cleaning, rinsing, or the like. The detergent composition that contacts the articles to be washed can be referred to as a concentrate or a use composition (or use solution) dependent upon the formulation employed in methods according to the invention. It should be understood that the concentration of the nonionic surfactants and other functional ingredients in the composition will vary depending on whether the detergent composition is provided as a concentrate or as a use solution.

A use solution may be prepared from the concentrate by diluting the concentrate with water at a dilution ratio that provides a use solution having desired detersive properties. The water that is used to dilute the concentrate to form the use composition can be referred to as water of dilution or a diluent, and can vary from one location to another. The typical dilution factor is between approximately 1 and approximately 10,000 but will depend on factors including the amount of soil and type of soil to be removed and the like. In an embodiment, the concentrate is diluted at a ratio of between about 1:10 and about 1:10,000 concentrate to water. Particularly, the concentrate is diluted at a ratio of between about 1:100 and about 1:5,000 concentrate to water. More particularly, the concentrate is diluted at a ratio of between about 1:250 and about 1:2,000 concentrate to water.

In an aspect of the invention, a use solution of the composition provides from about 0.01% to about 1% actives. In further aspects of the invention a use solution of the composition provides from about 0.01% to about 0.5% actives. Beneficially, the combination of the surfactants provide efficacious soil emulsification and removal at low concentrations. For example, beneficial results are achieved at concentrations as low as from about 0.01% to about 0.25% actives, from about 0.01% to about 0.15% actives, from about 0.01% to about 0.05% actives. In an aspect of the invention, a use solution of the composition has between about 1 ppm to about 1000 ppm linear alcohol ethoxylate surfactant, between about 1 ppm to about 1000 ppm branched alcohol ethoxylate surfactant (e.g. Guerbet alcohol ethoxylate), and between 1 ppm to about 1000 ppm EO-PO copolymer. In a preferred aspect of the invention, a use solution of the composition has between about 1 ppm to about 500 ppm linear alcohol ethoxylate surfactant, between about 1 ppm to about 500 ppm branched alcohol ethoxylate surfactant (e.g. Guerbet alcohol ethoxylate), and between 1 ppm to about 500 ppm EO-PO copolymer. In additional aspects of the invention, a use concentration of the various nonionic surfactants in the aqueous compositions of the invention is between about 100 ppm to about 5,000 ppm, from about 250 ppm to about 2,500 ppm, or more preferably from about 500 ppm to about 1,000 ppm nonionic surfactants. In addition, without being limited according to the invention, all ranges recited are inclusive of the numbers defining the range and include each integer within the defined range.

Applications of Use

In preferred aspects, the compositions are to be employed in the emulsifying of laundry soils and cleaning articles, e.g., textiles, which have become soiled. According to the invention, oily soils are emulsified, making them dispersible in a wash liquor. The compositions of the present invention can be used to remove stains from any conventional textile, including but not limited to, cotton, poly-cotton blends, wool, and polyesters. The compositions can be used on any item or article made from or including textile materials, woven fabrics, non-woven fabrics, and knitted fabrics. The textile materials can include natural or synthetic fibers such as silk fibers, linen fibers, cotton fibers, polyester fibers, polyamide fibers such as nylon, acrylic fibers, acetate fibers, and blends thereof including cotton and polyester blends. The fibers can be treated or untreated. Such textiles are commonly used as table linens, kitchen rages, chef coats, massage towels, etc. and other applications wherein greasy and oily soils are expected.

The compositions of the present invention are also textile tolerant, i.e., they will not substantially degrade the textile to which they are applied. The compounds of the present invention can be used to remove a variety of stains from a variety of sources including, but not limited to, lipstick, pigment/sebum, pigment/lanolin, soot, olive or other vegetable oils, mineral oil, motor oil, other oils, blood, make-up, red wine, tea, ketchup, organic grease and fat soils, including those from meat, protein and/or carbohydrate sources, any additional soils and combinations thereof.

In conventional, industrial and/or commercial laundry washing applications of use, the methods of removing soils from a textile may be employed either inside or outside a washing machine, when employing a method of removing soils in a laundry application. In some aspects, when the aqueous composition is employed outside the washing machine it is used in a concentrated formulation. In other aspects, when the aqueous composition is employed inside the washing machine it is used in a diluted (or a highly diluted) formulation, such as within the wash liquor of a washing machine in order to remove soils from textiles.

In a conventional, industrial laundry washing facility, textile materials can be subjected to several treatment steps in an industrial sized laundry washing machine to provide cleaning Exemplary treatment steps include a presoak or a prewash step, a wash step (e.g. soap and suds step), a rinse step for the removal of soil containing wash liquor, a bleach step (separate or in combination with the wash step), several optional rinse steps to remove the bleaching composition, an optional sour step to adjust the pH, softening step, and an extract step that often involves spinning the textiles to remove water. The compositions of the invention can be employed in such exemplary conventional prewash or presoak steps, washing steps, and/or alternatively be used in washing treatment steps that vary from such conventional processes. In addition, the compositions of the invention may be employed with a variety of laundry washing machines, including industrial, commercial and/or consumer machines (e.g. residential and/or home laundry washing machine).

The method for treating laundry according to the invention can be provided as part of an overall method for cleaning laundry according to the invention. That is, as part of a laundry cleaning operation, the compositions of the present invention can be used alone to treat the articles, e.g., textiles, or can be used in conjunction with conventional detergents suitable for the articles to be treated. A laundry cleaning process according to the invention can include the removal of soil, the removal of staining or the appearance of staining, and/or the reduction of a population of microbes. The compositions of the invention can be used with conventional detergents in a variety of ways, for example, the compositions of the invention can be formulated with a conventional detergent. Such formulation can include, for example, detergents for a prewash or pre-soak step and/or a soap/suds/bleach step. When the compositions of the invention are used in combination with conventional detergents, the compositions are employed to provide a detergency booster, such that the emulsifying efficacy of the compositions are combined with cleaning and/or bleaching efficacy of conventional detergents.

In other embodiments, the compositions of the invention can be used to treat the article as a separate additive from a conventional detergent. The compositions can be provided in the form of a concentrate that is diluted with water to provide a use solution. Alternatively, the compositions can be provided in the form of a use solution (already diluted with water). When used as a separate additive, the compositions of the present invention can contact the article to be treated at any time. For example, the compounds and compositions of the invention can contact the article before, after, or substantially simultaneously as the articles are contacted with the selected detergent.

The use solution can be used for washing the articles and/or emulsifying soils from the articles. In a preferred aspect, the compositions are applied to a warm prewash step (e.g. about 40-50° C.) to remove and emulsify excess grease and oil soils. In certain aspects, low water levels are employed for the warm prewash step. Thereafter the removal of the excess grease and oily soils from the surface of the article, the article can then be washed thoroughly in a main or conventional sud step (i.e. wash step) using detergents, bleaching agents and/or alkaline builders.

In such a preferred embodiment, the compositions contact the article before the articles are contacted with the selected detergent, e.g. a pre-soak or a pre-wash situation, wherein the articles are contacted with the composition of the invention initially to emulsify soils on the substrate fabric. This step may include a contact time from a few minutes to a few hours, such as from about 2 hours to about 8 hours. This step may optionally include the use of a builder or component compositions for providing a source of alkalinity, such as to increase the pH from neutral to an alkaline pH, including for example of a pH of at least 10, or at least 11 or greater. The step may be conducted at a broad range of temperatures due to the unique blend of surfactants employed. For example, the pre-soak and/or pre-wash step may be at a use temperature of from about room temperature to at least about 60-70° C. for a period of time effective to remove excess soils through emulsification.

In an alternative embodiment, the compositions may be combined with a bleaching and/or antimicrobial step, such that the emulsifying composition according to the invention is a detergent booster in a main wash step which increases the level of nonionic surfactants in the system. This bleaching and antimicrobial step can follow or precede steps of washing the laundry with a composition of the invention and draining and/or rinsing the composition solution from the laundry. In other applications, it is expected that the bleaching and antimicrobial step can occur simultaneously with the washing step. It is expected that in situations where the soiling is relatively light, it may be advantageous to combine the washing step employing the emulsifying composition of the invention with the bleaching and antimicrobial step. That is, the bleaching and antimicrobial step can include a soil removal step and/or it can occur before or after a soil removal step.

In a preferred aspect of the invention, the aqueous emulsifying composition is particularly suited for use as a pretreatment (i.e. pre-spotting) of stains on soiled articles using concentrated compositions outside of a washing machine. Such methods are preferably followed by a regular wash/laundry process, such as those disclosed herein the description of the invention.

In another preferred aspect of the invention, the aqueous emulsifying composition is particularly suited for use as a presoak of a soiled article, such as a linen, within a container or vessel that is filled with water containing a dose of the aqueous emulsifying composition. Such methods are preferably followed by a regular wash/laundry process, such as those disclosed herein the description of the invention.

In another preferred aspect of the invention, the aqueous emulsifying composition is particularly suited for use as a prewash step with or without added alkalinity (also referred to herein as a builder) in the washing machine. Such methods may be include the use of laundry detergents or may proceed the steps of using laundry detergents, such as having the wash/laundry process follow with the subsequent use of other wash steps with main detergent, etc. Such exemplary processes are disclosed herein the description of the invention.

In another preferred aspect of the invention, the aqueous emulsifying composition is particularly suited for use as an additive composition within a regular wash/laundry process. For example, as disclosed herein the aqueous emulsifying compositions can be employed as a detergency booster to a regular suds bath (regular wash/laundry process) which already contains a main detergent, alkalinity, and/or possibly bleach. Such exemplary processes are disclosed herein the description of the invention.

Additional description of suitable laundry methods which may employ the compositions of the present invention are set forth, for example, in U.S. patent application Ser. No. 12/726,073, which is herein incorporated by reference in their entirety.

In other aspects, the compositions of the present invention can be used as a cleaning agent and/or bleaching agent to whiten or lighten or remove stains from a substrate, e.g., hard surface. The compositions are particularly suitable for treating non-laundry articles and surfaces including hard surfaces such as dishes, glasses, and other ware.

Those skilled in the art will recognize, or be able to ascertain using no more than routine experimentation, numerous equivalents to the specific procedures, embodiments, claims, and examples described herein. Such equivalents are considered to be within the scope of this invention and covered by the claims appended hereto. The contents of all references, patents, and patent applications cited throughout this application are indicative of the level of ordinary skill in the art to which this invention pertains, and are hereby incorporated by reference. The invention is further illustrated by the following examples, which should not be construed as further limiting.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Example 1

A tergotometer test procedure was employed to measure detergency of test compositions according to the invention. A tergotometer along with 500 mL pots and water bath were employed. First, unwashed swatches from the lot numbers to be used in the test are read on the Konica Minolta Spectrophotometer model CM-3600d to establish the average initial (before washing) L value. A sampling of 25 of each swatch type is used. The desired wash temperature is programmed into the Tergotometer and its water bath is allowed to heat up to that temperature. 500 mL of the desired water type is added to each Tergotometer pot and allowed to equilibrate to the desired temperature.

Test swatches (clean) were dipped into the solution of interest (e.g. chili oil, etc.). The soiled swatches are dried overnight before the detergency experiment. The following standard, commercially available (EMPA) soiled swatches were used for baseline testing in the Examples, as shown in Table 2.

TABLE 2

| Sample | Soil | Substrate Fabric |
|---|---|---|
| EMPA 101 | olive oil/carbon black | cotton |
| EMPA 104 | olive oil/carbon black | cotton blend |
| EMPA 106 | mineral oil | cotton |

The test detergent compositions are weighed out and added to the Tergotometer pots. Various detergent compositions as shown in Table 3 were employed. The baseline comparisons included a commercially-available NPE-containing laundry emulsifier/detergent, along with an NPE-free laundry emulsifier/detergent.

TABLE 3

| Sample | Description | Actives |
|---|---|---|
| Control-NPE | NPE-containing | Alkyl phenol ethoxylates with varying degrees of ethoxylation |
| Control-NPE-free | NPE-free | Blended linear alkyl ethoxylates |
| F43 | NPE-free nonionic surfactant blend | Nonionic surfactant blend: Liner fatty alcohol ethoxylate EO-PO block copolymer |
| F64 | NPE-free nonionic surfactant blend | Nonionic surfactant blend: Linear fatty alcohol ethoxylate Guerbet alcohol ethoxylate (4 moles) EO-PO block copolymer |
| F70 | NPE-free nonionic surfactant blend | Nonionic surfactant blend: Linear fatty alcohol ethoxylate Guerbet alcohol ethoxylate (5 moles) EO-PO block copolymer |
| F150 | Stabilized NPE-free nonionic surfactant blend | Nonionic surfactant blend: Linear fatty alcohol ethoxylate Guerbet alcohol ethoxylate (5 moles) EO-PO block copolymer Stabilizing Agents (propylene glycol, isopropyl alcohol) |
| F1 | NPE-free nonionic surfactant blend | Nonionic surfactant blend: Guerbet alcohol ethoxylate (7 moles) Alkyl polyethylene glycol ethers from C10 Guerbet alcohol and alkylene oxides C8-C16 Alkyl polyglycoside Branched alcohol ethoxylates |
| F2 | NPE-free nonionic surfactant blend | Nonionic surfactant blend: Linear Alcohol Guerbet alcohol ethoxylate (7 moles) C8-C16 Alkyl polyglycoside Branched alcohol ethoxylates |
| F3 | NPE-free nonionic surfactant blend | Nonionic surfactant blend: Linear Alcohols Guerbet alcohol ethoxylate (7 moles) C8-C16 Alkyl polyglycoside |
| F4 | NPE-free nonionic surfactant blend | Nonionic surfactant blend: Linear Alcohol Guerbet alcohol ethoxylate (7 moles) C8-C16 Alkyl polyglycoside |

The detergent systems were agitated for 30 sec to 1 minute (longer if necessary) to mix and dissolve in a hard water system (5 grains) to form a use solution of 0.03% in the hard tap water (concentration 0.03% unless indicated otherwise). The agitation/mixing speed RPM was adjusted to 200. The temperature of the detergent compositions dissolved in water were 30° C., unless indicated otherwise in the Figures/Examples set forth below. The swatches are added quickly to their respective pots in a left to right sequence in order to minimize differences in exposure time to the detergent systems. A wash run is completed for at least 10 minutes. At the end of the run, the swatches are removed from the pots quickly in a left to right sequence using a forceps and are transferred into 500 mls-1 liter of cold water to rinse. One container of cold rinse water is used for each pot. The swatches are removed from the cold water and are further rinsed under cold tap water using a strainer or colander in a sink. After rinsing with cold tap water, excess water from the swatches was removed by squeezing the swatches. The process was repeated with rinsing and squeezing excess water at least 2 more times. The swatches were air dried on a visa napkin or paper towel on the lab bench.

The swatches were then read on the HunterLab Color Quest and calculate % soil removal (i.e. whiteness) from the difference between the initial (before washing) L value and the final L value (after washing). Percent Soil Removal=(L after−L initial)/(96−L initial)*100 is represented as L*.

As shown in FIG. 1 test compositions F43 and F64 provided improved oily soil removal (shown as % L* diff) over both control formulations, including the NPE-containing and NPE-free compositions. Beneficially, the test compositions according to the invention provide superior cleaning performance (namely oily soil removal) in comparison to controls.

Example 2

The beneficial results obtained in Example 1 were further analyzed in the presence of a builder product to increase the pH conditions of the laundry application. The methods of Example 1 were employed along with the use of an alkalinity-containing builder composition (commercially-available from Ecolab, Inc.). The building provides to the cleaning system a source of sodium hydroxide and a polyacrylate (to control build-up caused by the hard water employed). The pH of the cleaning systems was increased from about neutral to a pH between about 11.3 to about 11.5 with the addition of the builder component, with all other test conditions remaining constant.

Figure 2:
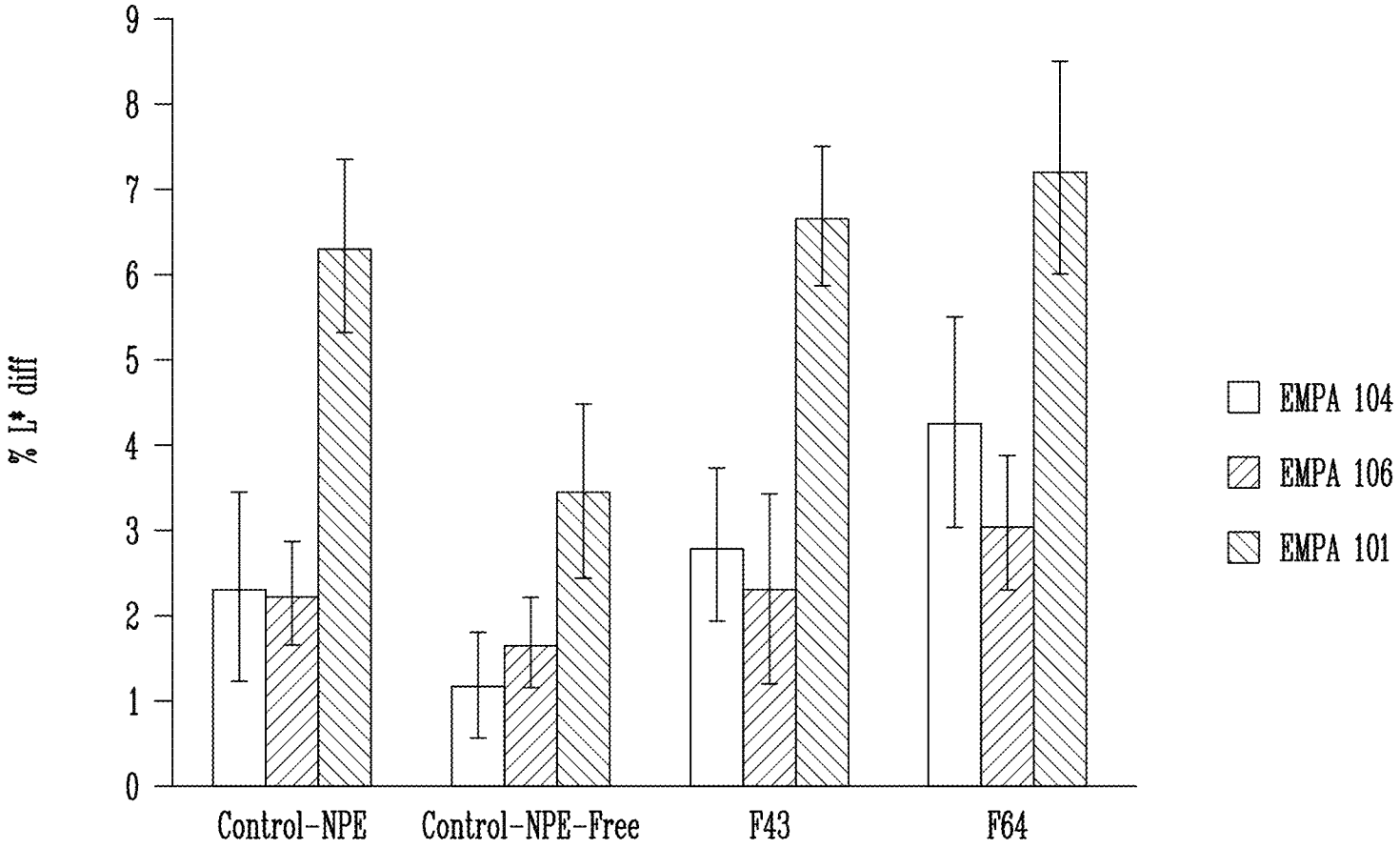
FIG. 2 shows a graph of soil removal capacity of compositions according to embodiments of the invention as shown in FIG. 1 with the addition of a source of alkalinity to demonstrate further detergency benefits in comparison to baseline NPE-containing and NPE-free control compositions.

As shown in FIG. 2 both test compositions F43 and F64 provided improved soil removal (shown as % L* diff) over both control formulations, including the NPE-containing and NPE-free compositions. The inclusion of a building to increase the pH conditions of the laundry cycle provided increased soil removal (shown as % L* diff) in comparison to the results shown in FIG. 1. Again, the test compositions according to the invention provide superior cleaning performance (soil removal) in comparison to controls.

Figure 3:
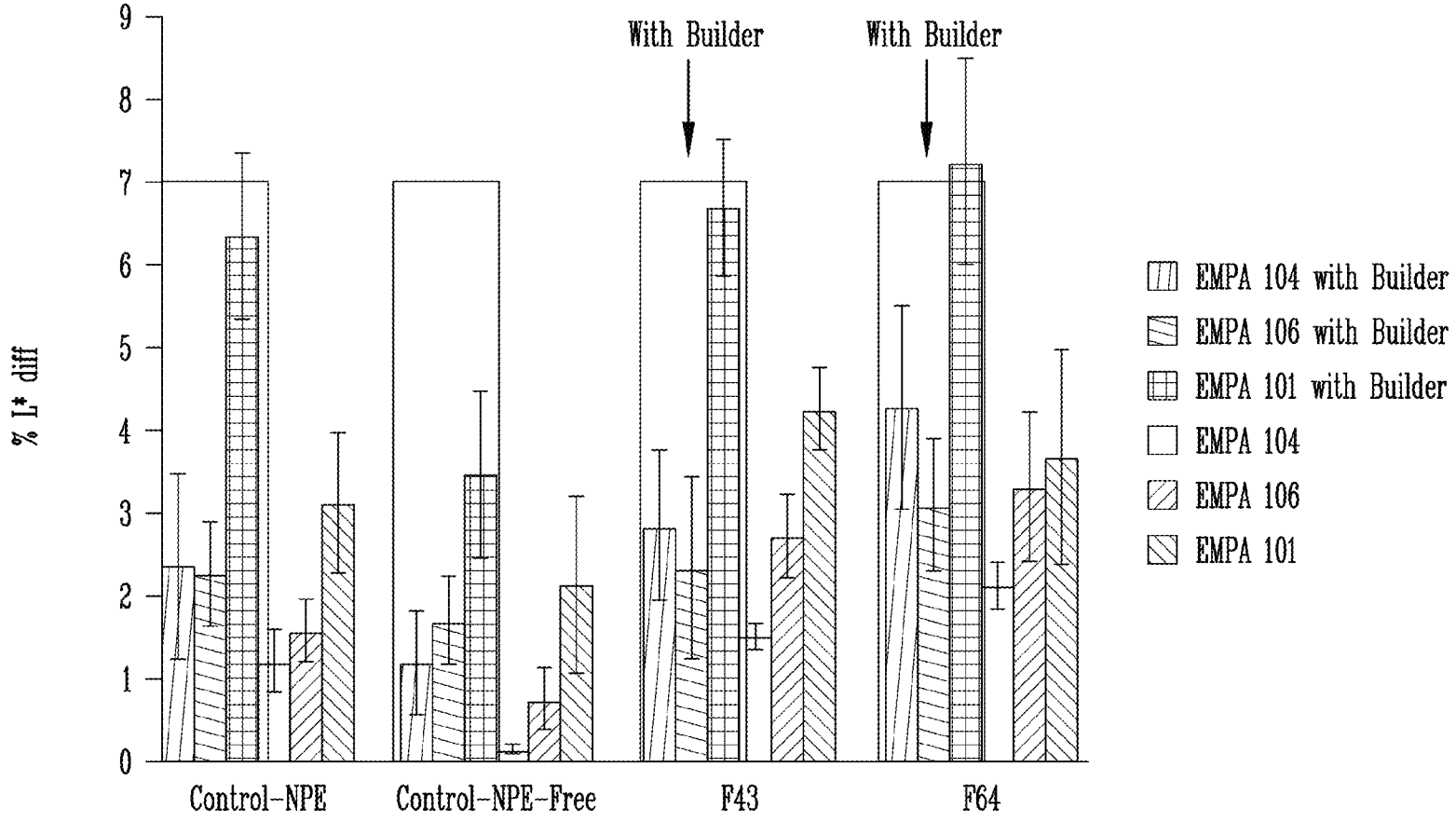
FIG. 3 shows a graph combining the results of FIGS. 1-2 to demonstrate the additional efficacy of soil removal with the addition of a source of alkalinity (e.g. builder component) according to an embodiment of the methods of the invention.

FIG. 3 further demonstrates that additional detergency and soil removal achieved with the combination of the builder component with the compositions of the invention. This figure shows the side-by-side comparison of FIG. 1 and FIG. 2 data sets.

Example 3

Additional testing of the compositions according to the invention were conducted at additional higher temperature ranges. The methods of Example 1 were further conducted using the laundry emulsifiers (F43, F64) in comparison to controls (NPE-containing, NPE-free) at temperatures of 30° C., 40° C., and 50° C.

Figure 4:
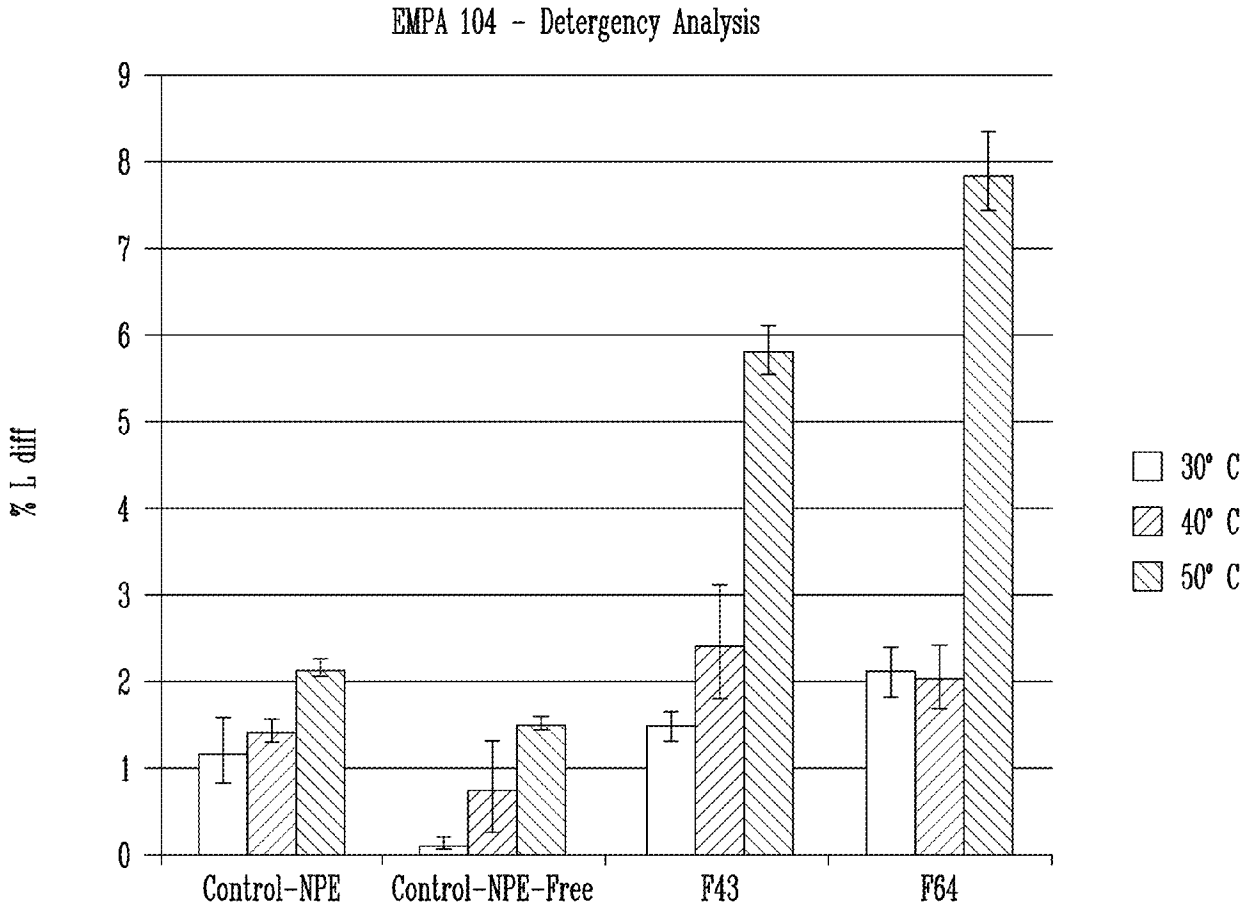
FIGS. 4-6 show graphs of the effect of temperature variations on the soil removal efficacy of the compositions according to embodiments of the invention on various soils and laundry textiles.
Figure 5:
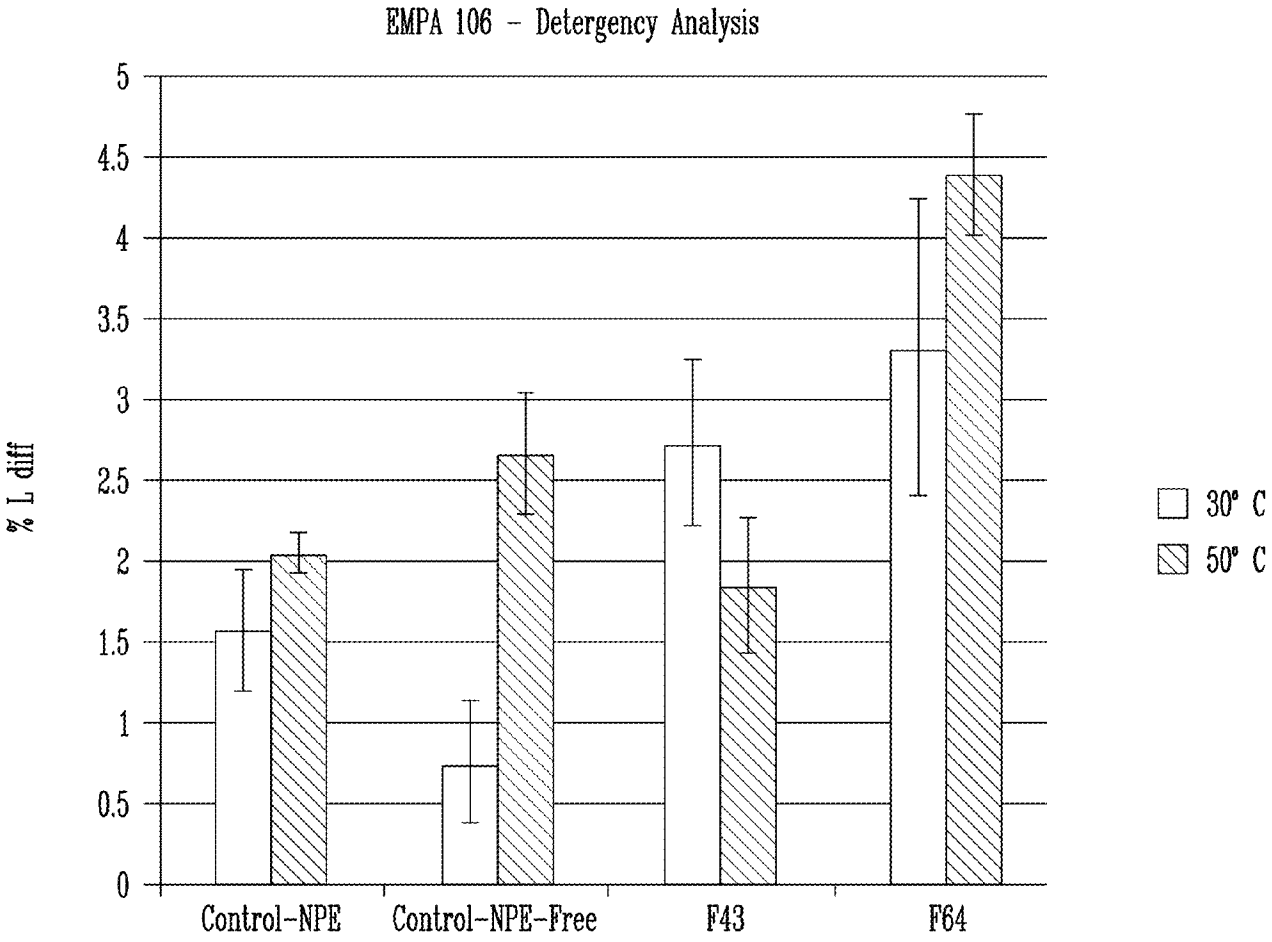
Figure 6:
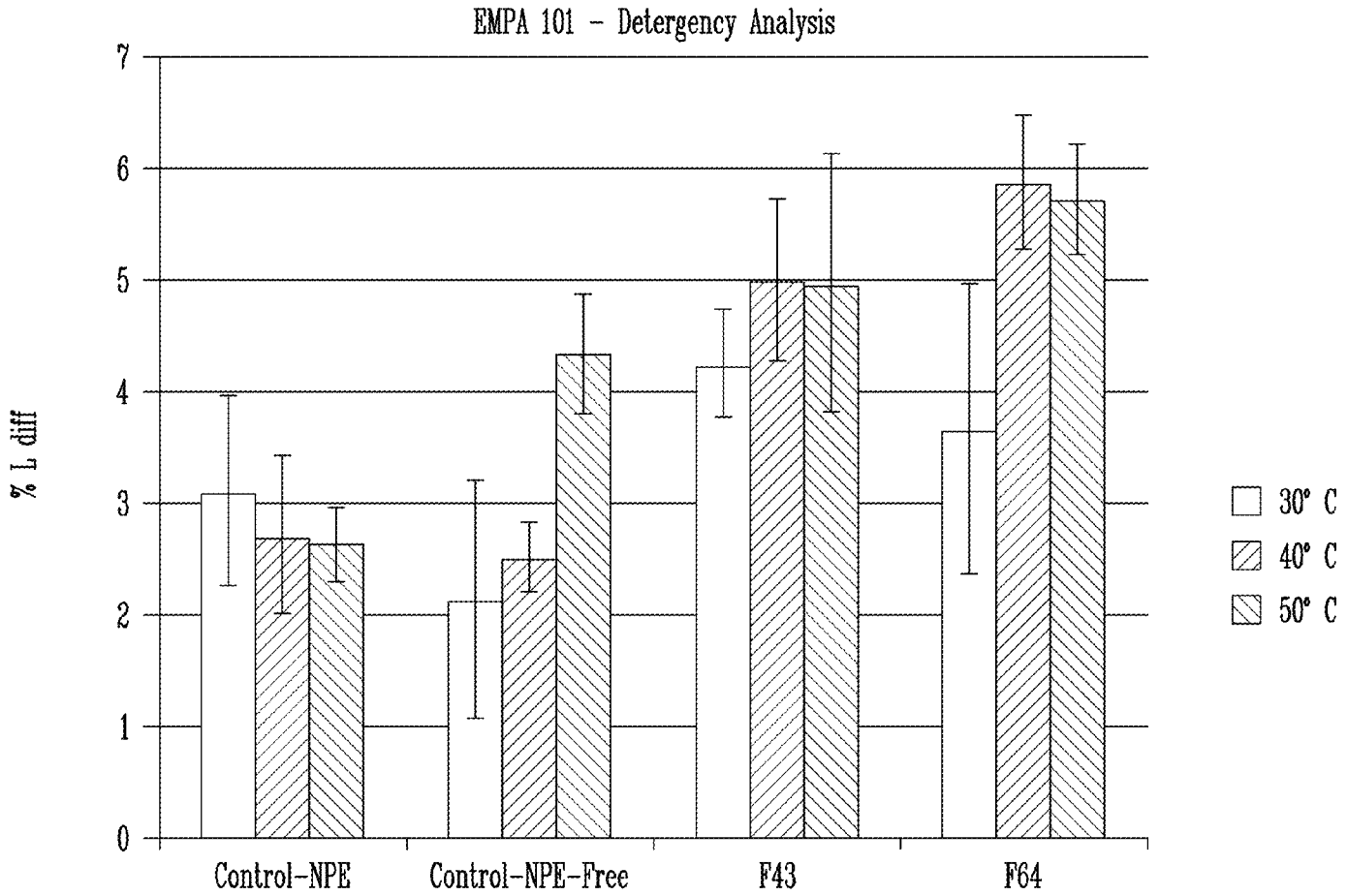

FIG. 4 shows the results of the test formulations on EMPA 104 swatches at varying temperatures. FIG. 5 shows the results of the test formulations on EMPA 106 swatches at varying temperatures. FIG. 6 shows the results of the test formulations on EMPA 101 swatches at varying temperatures. The test compositions outperform the controls at all temperatures analyzed.

Example 4

Figure 7:
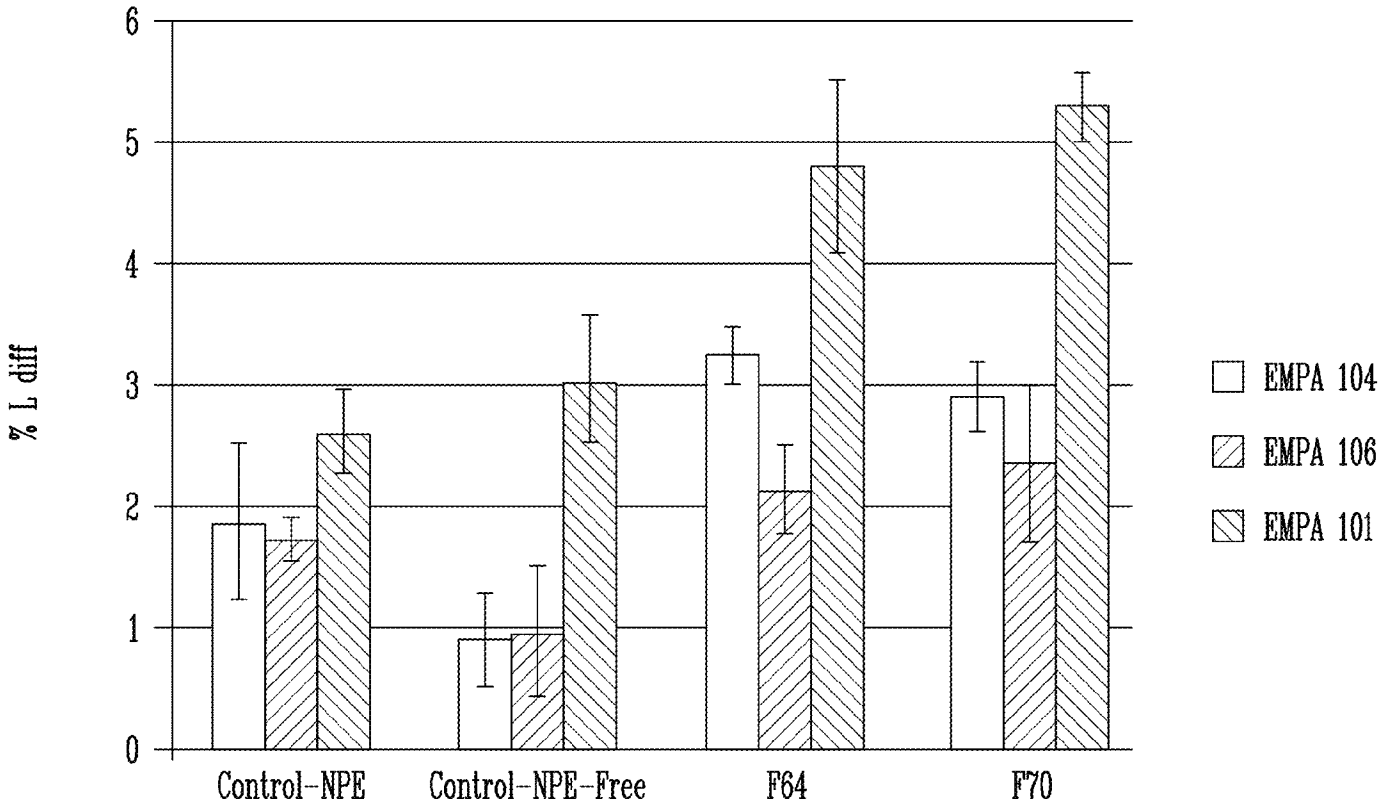
FIG. 7 shows a graph of the detergent efficacy of additional NPE-free emulsifier compositions according to an additional embodiment of the invention.

Additional compositions according to the invention were analyzed to determine the impact of the degree of ethoxylation of the Guerbet alcohol ethoxylates. The methods of Example 1 were conducted at a temperature of 40° C. and using a 0.05 wt-% actives concentration of the use solutions (2 mL/kg linens). The laundry emulsifiers (F64, F70) demonstrated improved detergency in comparison to both controls (NPE-containing, NPE-free) on all soil and linens evaluated, as shown in FIG. 7.

Figure 8:
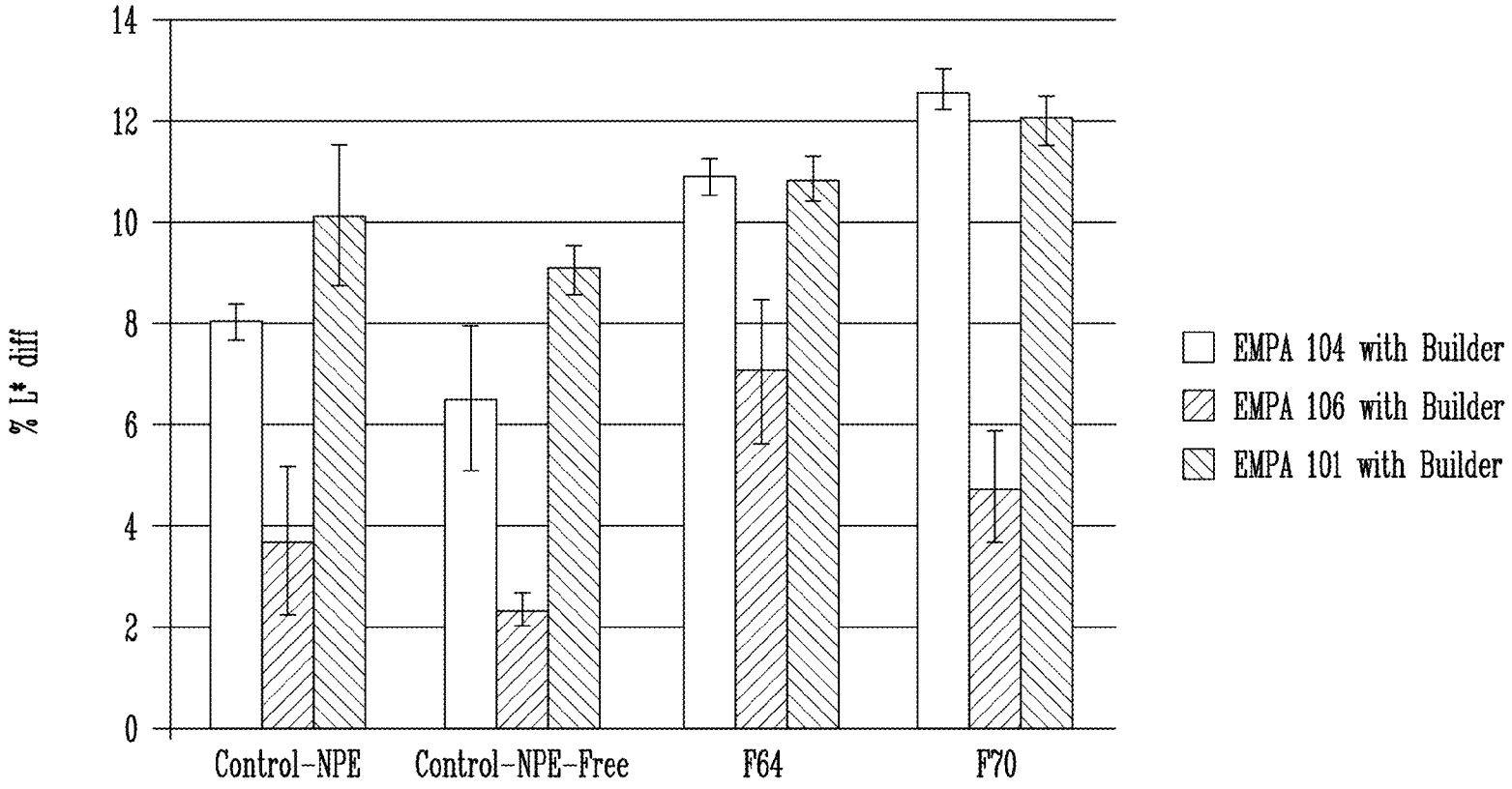
FIG. 8 shows a graph of the detergent efficacy of additional NPE-free emulsifier compositions in combination with a source of alkalinity according to an additional embodiment of the invention.
Figure 9:
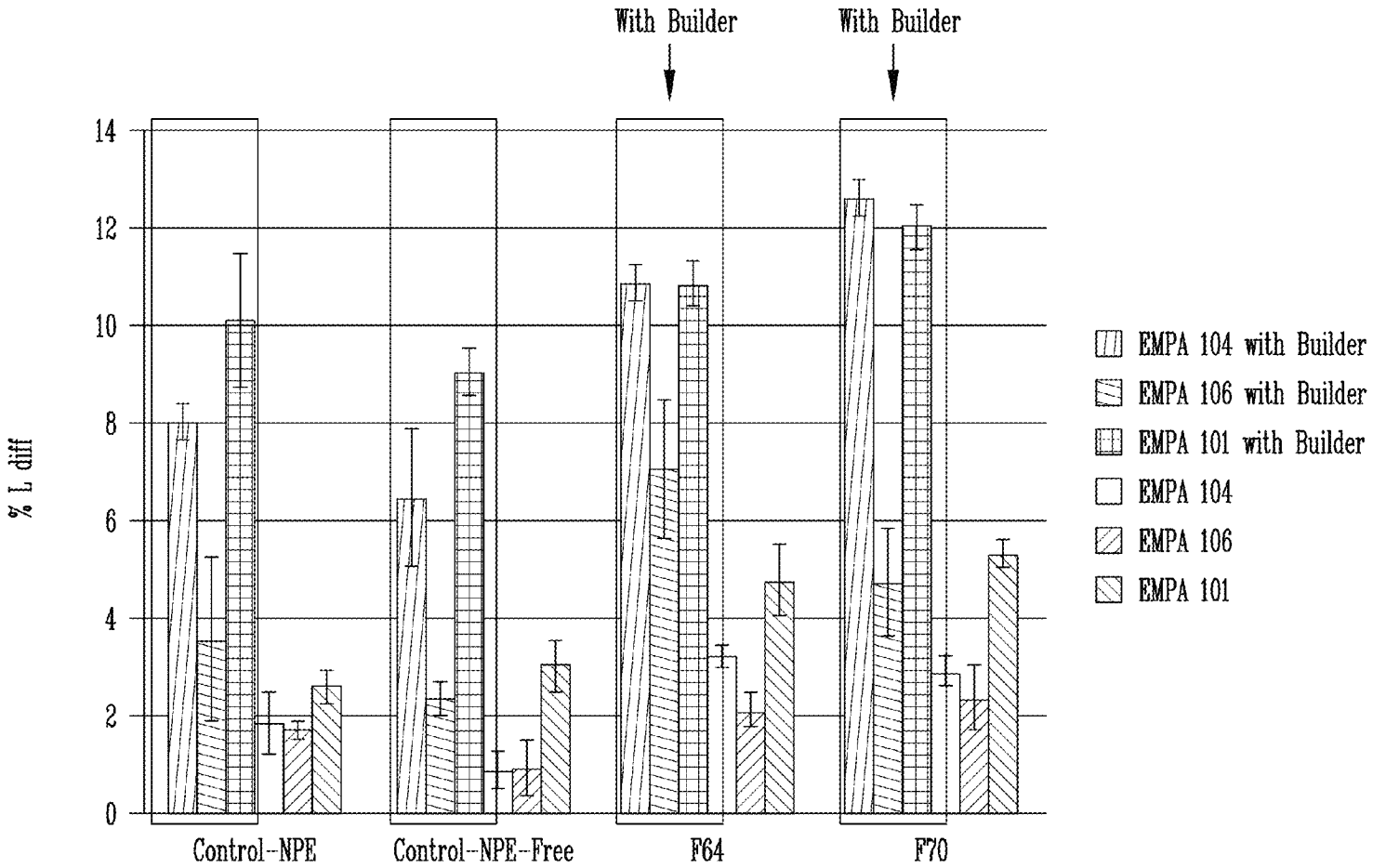
FIG. 9 shows a graph combining the results of FIGS. 7-8 to demonstrate the additional efficacy of soil removal with the addition of a source of alkalinity (e.g. builder component) according to an embodiment of the methods of the invention.

The methods of Example 2 employing a builder component with the use solutions of the compositions were further analyzed. The builder was added at 6 mL/kg linens to reach a pH of 12. The laundry emulsifiers (F64, F70) demonstrated additional improvements in detergency in comparison to the results of FIG. 7 and the resulted obtained by both controls (NPE-containing, NPE-free) on all soil and linens evaluated, as shown in FIG. 8. FIG. 9 shows a comparison of the results from FIGS. 7-8, showing an embodiment of the invention of enhanced or boosted detergency with the emulsifier compositions according to the invention when used in combination with a builder (i.e. alkalinity source) or washing at elevated pH (above neutral).

Example 5

Figure 10:
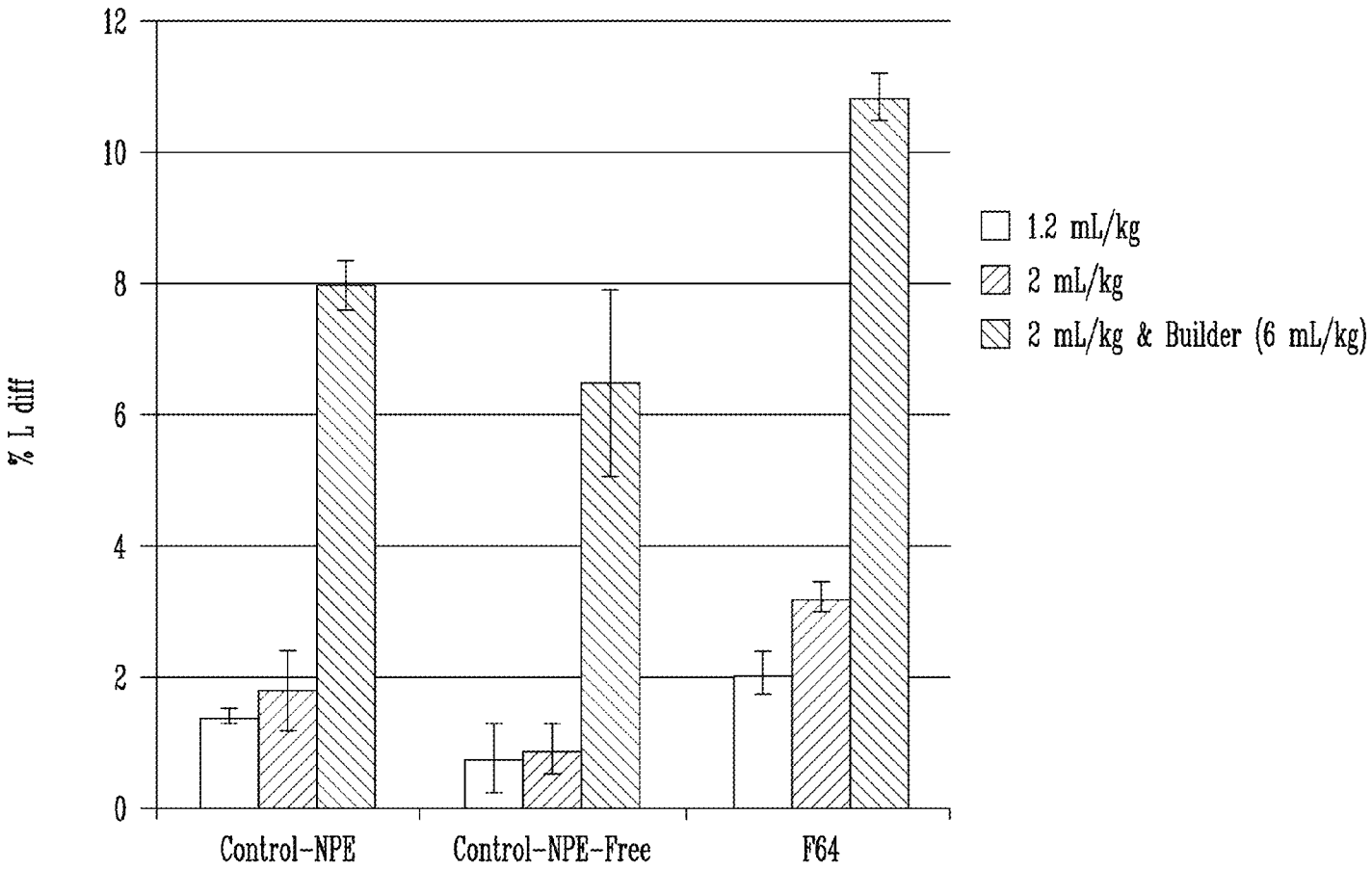
FIG. 10 shows a graph of soil removal capacity of an exemplary composition according to embodiments of the invention at varying use solution concentrations (% actives), with and without the use of a builder to increase pH of the cleaning solution.

A preferred NPE-free composition according to the invention was further analyzed to determine the impact of the concentration of the use solution on the soil removal in comparison to controls. The methods of Example 1 were conducted using the EMPA 104 soiled swatches at concentrations of 1.2 mL/kg (0.03% actives), 2 mL/kg (0.05% actives) and 2 mL/kg with a builder (source of alkalinity at 6 mL/kg). The results are shown in FIG. 10. The laundry emulsifier according to the invention (F64) demonstrated improved detergency in comparison to both controls (NPE-containing, NPE-free).

Beneficially, the addition of a builder provides significantly more detergency improvement that the increase in use concentration of the composition achieves alone. According to an embodiment of the invention, the use of a builder (source of alkalinity) provides significant improvements in detergency.

Example 6

Additional soils were formulated to further analyze the detergency of the emulsifying compositions according to the invention. Chili oil samples were formulated on polyester and cotton blend swatches to generate difficult-to-treat yellow stains. The NPE-free laundry emulsifier compositions (F64, F70) were analyzed against the chili oil stains to determine their efficacy using the remaining methods of Example 1.

Figure 11:
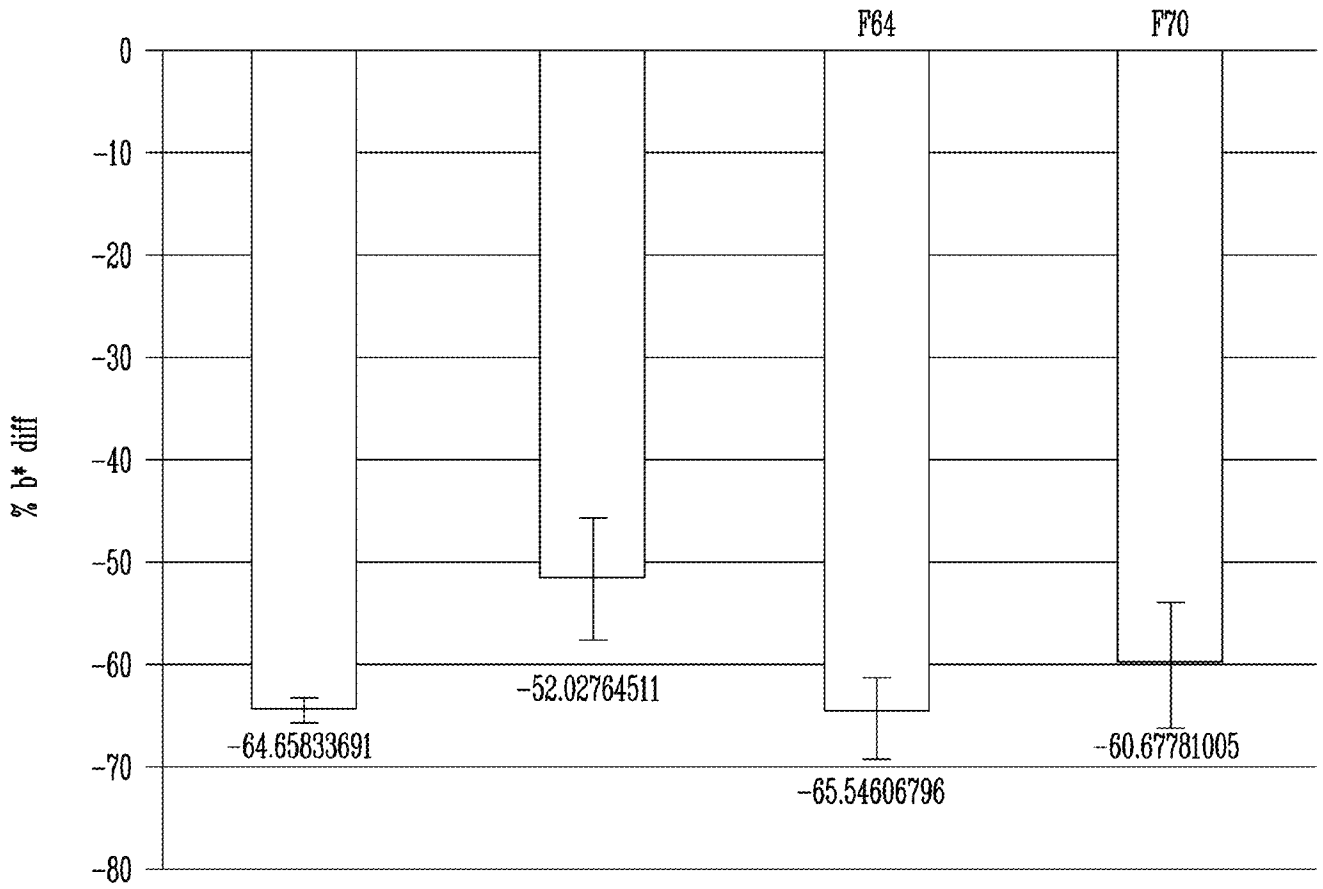
FIG. 11 shows a graph of the b value (removal of yellowing from soiled swatch) of the test compositions and control formulations from textiles soiled with chili oil.

The tergotometer was employed to analyzed the b value (i.e. removal of yellowing from linen swatch) of the various test compositions and control formulations. The extent of the removal of yellow spectrum from the linen swatches were measured, wherein the lower the b value indicates detergency. As shown in FIG. 11, the laundry emulsifiers (F64, F70) demonstrated at least equivalent detergency to the NPE-containing control and improved detergency in comparison to the NPE-free control.

Example 7

The stability of the compositions according to the invention were further analyzed by adding stabilizing agents propylene glycol and isopropyl alcohol to the formulation of F70 employed in Examples 4 and 6. The methods of Example 1 were employed at temperatures of 30° C. and 50° C. using 0.05 wt-% actives in use solution (2 mL/kg linen). Thereafter, the methods of Example 2 using a builder component to increase the pH of the use compositions (0.15 wt-% active) from neutral to pH 11.7 were analyzed. A mixing speed of 130 rpm was employed for 10 minutes for both tests at varying temperatures.

Figure 12:
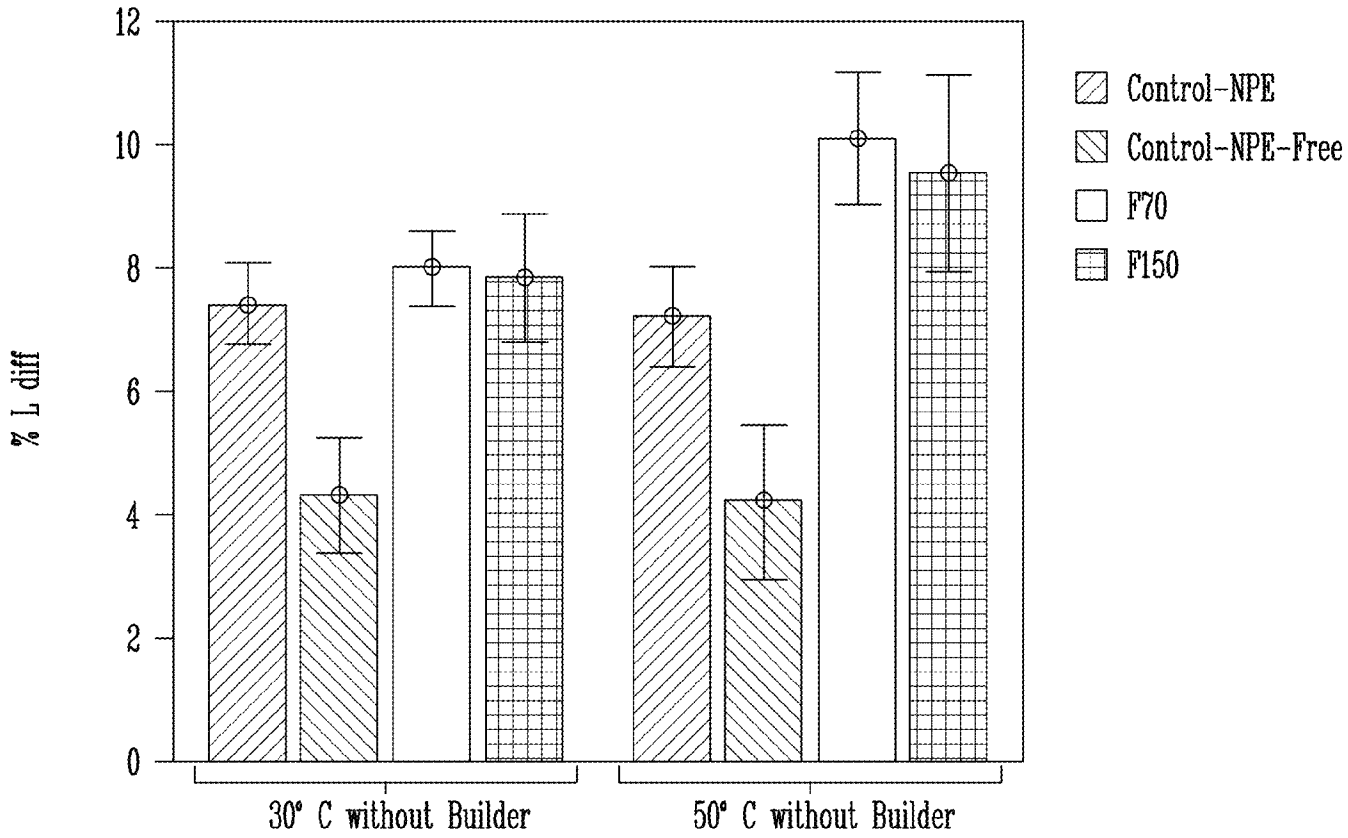
FIGS. 12-14 show graphs of the comparison of detergency of various compositions (with and without builder components) according to embodiments of the invention at different temperatures.
Figure 13:
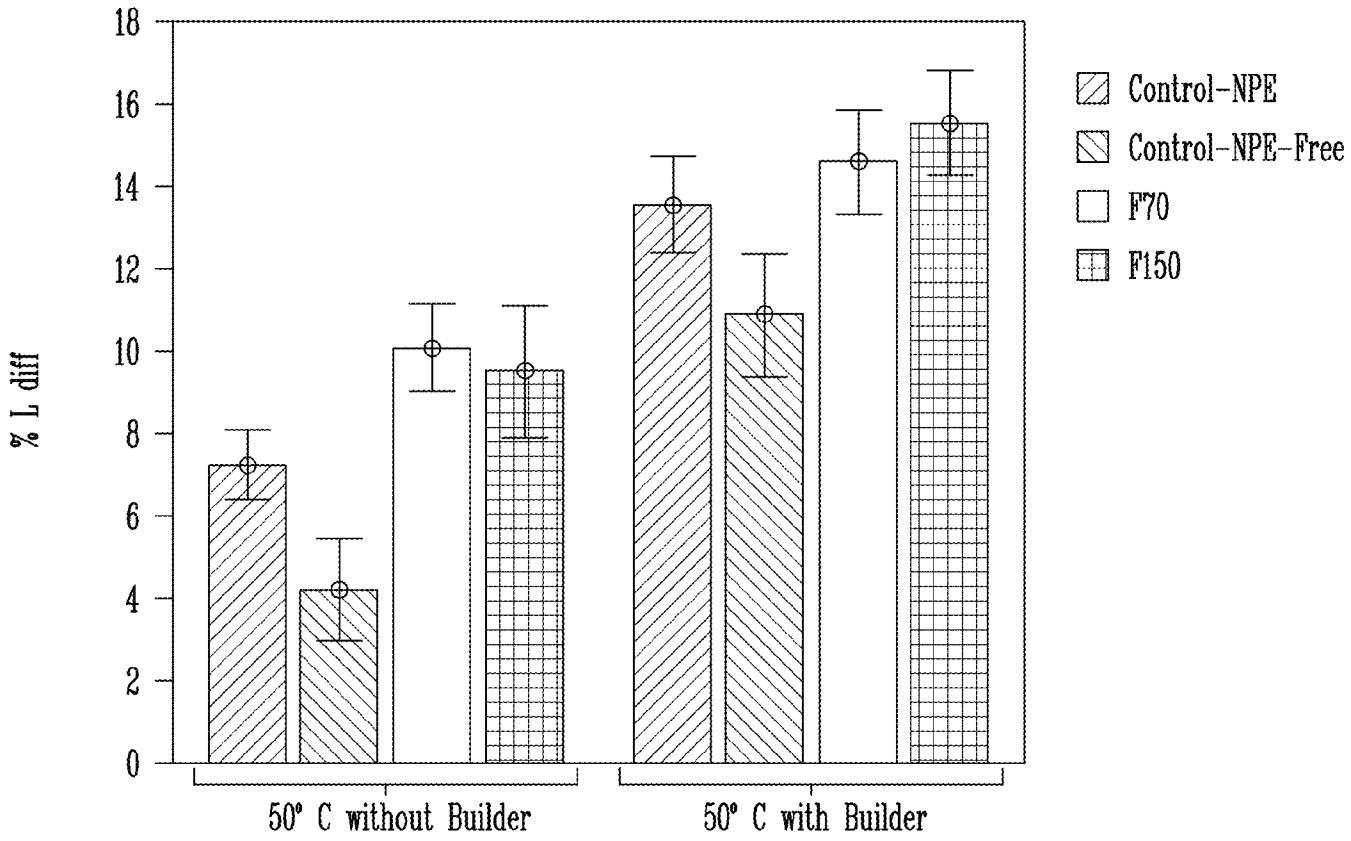
Figure 14:
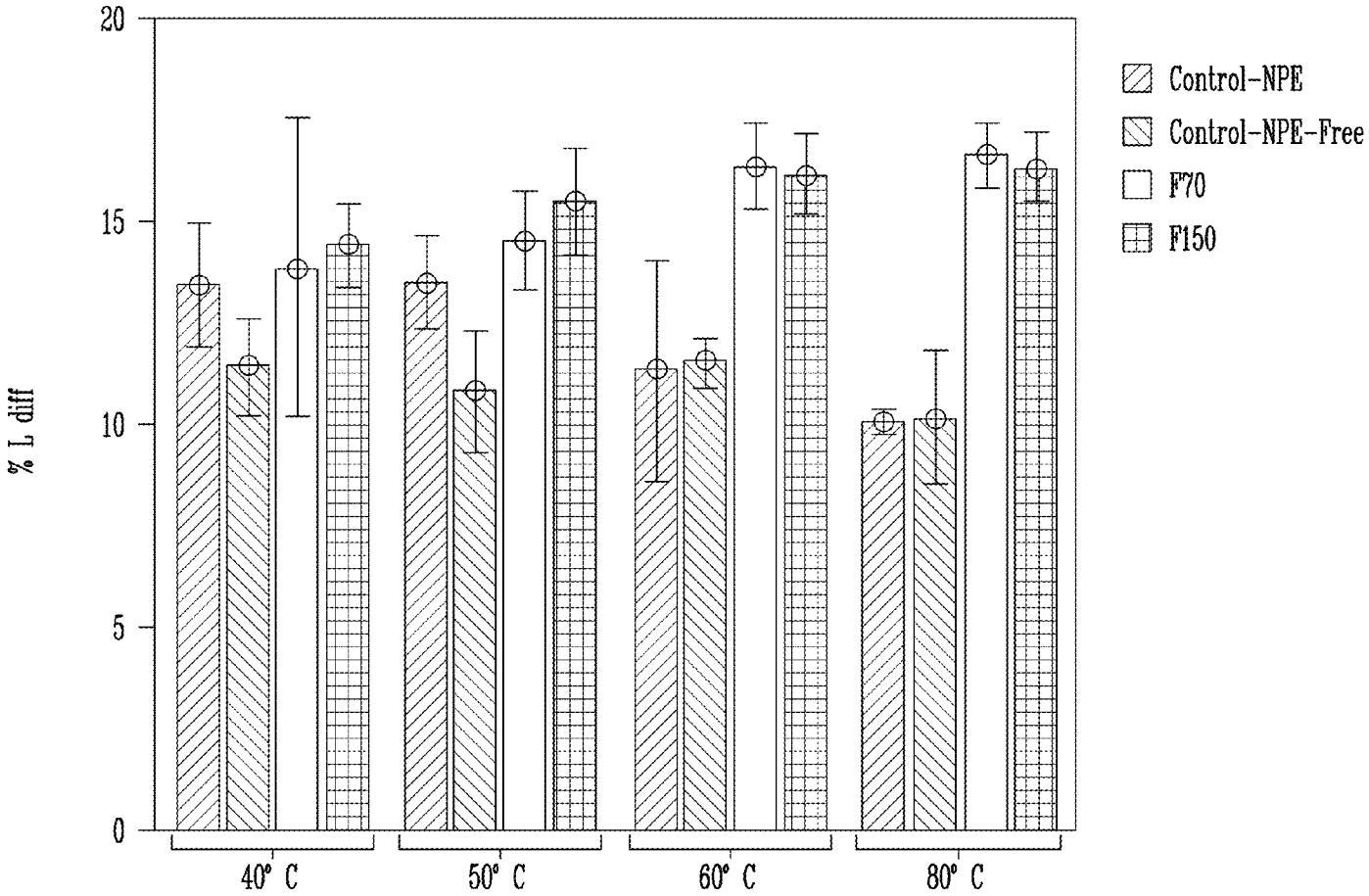

The results are shown in FIG. 12 for the compositions tested without a builder component, wherein both the F70 and F150 compositions according to embodiments of the invention provided improved detergency over control formulations (both NPE-containing and NPE-free controls). FIG. 13 shows additional results at 50° C. with and without a builder component. FIG. 14 shows a comparison at temperatures of 40° C., 50° C., 60° C., and 80° C. wherein the compositions (both stabilized and only active compositions) outperform the controls according to the embodiments of the invention using a builder to increase the pH of the use composition. Beneficially, the inclusion of stabilizing agents into the compositions to provide phase stability does not impart any negative performance.

The inventions being thus described, it will be obvious that the same may be varied in many ways. Such variations are not to be regarded as a departure from the spirit and scope of the inventions and all such modifications are intended to be included within the scope of the following claims.

What is claimed is:

1. A concentrated pre-treatment or pre-soak APE-free composition comprising:

from about 40 wt-% to about 95 wt-% of a nonionic surfactant blend, wherein the surfactant blend comprises a linear fatty alcohol ethoxylate, a branched fatty alcohol ethoxylate comprising a Guerbet ethoxylate, and an ethylene oxide-propylene oxide copolymer; and optionally from about 5 wt-% to about 60 wt-% a stabilizing agent and/or water;

wherein the Guerbet ethoxylate has the formula

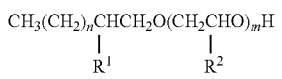

wherein R1 is C2-C20 alkyl, R2 is H or C1-C4 alkyl, n is an integer between 2 and 20, and m is an integer between 1 and 40; and wherein the ratio of said linear fatty alcohol ethoxylate to said branched fatty alcohol ethoxylate to said ethylene oxide-propylene oxide copolymer is from about 1:1:1 to about 10:1:10.

2. The composition of claim 1 wherein said linear fatty alcohol ethoxylate is a linear ethoxylated $C_6$-$C_{18}$ fatty alcohol having a degree of ethoxylation from 4 to 10.

3. The composition of claim 1 wherein said branched fatty alcohol ethoxylate is from about 1 wt-% to about 50 wt-% of the composition.

4. The composition of claim 1 wherein said Guerbet ethoxylate has at least 4 moles ethylene oxide.

5. The composition of claim 1 wherein said ethylene oxide-propylene oxide copolymer has a molecular weight less than about 10,000.

6. The composition of claim 1 wherein said linear fatty alcohol ethoxylate comprises from about 1-80 wt-% of said composition, said Guerbet ethoxylate comprises from about 1-75 wt-% of said composition, and said ethylene oxide-propylene oxide copolymer comprises from about 1-80 wt-% of said composition.

7. The composition of claim 1 further comprising a glycol and/or an alcohol as stabilizing agent and/or water.

8. A concentrated pre-treatment or pre-soak APE-free composition comprising:

a linear fatty alcohol ethoxylate;

a branched fatty alcohol ethoxylate comprising a Guerbet ethoxylate;

an ethylene oxide-propylene oxide copolymer;

at least one stabilizing agent; and water;

wherein the Guerbet ethoxylate has the formula

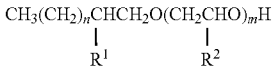

wherein R1 is C2-C20 alkyl, R2 is H or C1-C4 alkyl, n is an integer between 2 and 20, and m is an integer between 1 and 40; and wherein the ratio of said linear fatty alcohol ethoxylate to said branched fatty alcohol ethoxylate to said ethylene oxide-propylene oxide copolymer is from about 1:1:1 to about 7.5:1:5.

9. The composition of claim 8 wherein said linear fatty alcohol ethoxylate is a linear ethoxylated $C_6$-$C_{18}$ fatty alcohol having a degree of ethoxylation from 4 to 10, wherein said ethylene oxide-propylene oxide copolymer has a molecular weight less than about 10,000, and wherein the ratio of said linear fatty alcohol ethoxylate to said branched fatty alcohol ethoxylate to said ethylene oxide-propylene oxide copolymer is from about 1:1:1 to about 2:1:2.

10. The composition of claim 8 wherein said linear fatty alcohol ethoxylate is a linear ethoxylated $C_6$-$C_{18}$ fatty alcohol having a degree of ethoxylation B from 4 to 10, and wherein said ethylene oxide-propylene oxide copolymer has a molecular weight less than about 10,000.

11. The composition of claim 8 wherein said linear fatty alcohol ethoxylate comprises from about 1-80 wt-% of said composition, said Guerbet ethoxylate comprises from about 1-75 wt-% of said composition, said ethylene oxide-propylene oxide copolymer comprises from about 1-80 wt-% of said composition, and said stabilizing agent(s) comprises from about 1-60 wt-% of said composition.

12. A method for removing stains from fabric or hard surfaces comprising the steps of:

contacting a soiled article or surface with an aqueous composition comprising the composition of claim 1 for a period of time sufficient to achieve emulsification of soils and removal of soils from said article or surface.

13. The method of claim 12 wherein said contacting is for a period of at least a few minutes to a few hours.

14. The method of claim 12 wherein said contacting includes suspending said article to be cleaned in said composition within a container or vessel filled with the aqueous composition and water.

15. The method of claim 12 wherein said contacting is a pre-spotting emulsification step outside of a washing machine.

16. The method of claim 14 or 15 further comprising cleaning or laundering the treated article or surface with a conventional aqueous detergent with or without an added source of alkalinity.

17. The method of claim 16 wherein said laundering/cleaning step is NPE-free and APE-free.

18. The method of claim 12 wherein said solution is at a temperature from about room temperature to about 70° C.

19. The method of claim 12 wherein said composition contacts said article or surface in combination with an alkalinity source to increase the pH to above neutral.

20. The method of claim 12 wherein said composition contacts said article or surface in combination with an additional bleaching detergent composition to provide a detergent emulsifier boost for improved soil removal from said article or surface.

21. The method of claim 12 further comprising a bleaching step, one or more rinse steps, a souring step and/or a softening step.

22. A method for removing stains from fabric or hard surfaces comprising the steps of:

contacting a soiled article with an aqueous composition comprising the composition of claim 1 for a period of time sufficient to achieve emulsification of soils and removal of soils from said article; and adding a detergent composition to the article contacted with the aqueous emulsifying composition within a washing machine to launder said soiled article.

23. The method of claim 22 wherein said aqueous emulsifying composition is provided first as a pre-spotting treatment for said soiled articles within or outside of said washing machine.

24. The method of claim 22 wherein said aqueous emulsifying composition is provided in combination with said detergent composition as a detergency booster for improved soil removal from said articles within a washing step (suds step) within said washing machine.

25. The method of claim 22 wherein said detergent composition is also NPE-free and APE-free.

26. The method of claim 22 wherein said aqueous emulsifying composition contacts said soiled article in combination with an alkalinity source to increase the pH to about neutral.

27. The method of claim 22 further comprising additional bleaching step(s), one or more rinse step(s), a souring step(s) and/or a softening step(s).

28. The composition of claim 1, further comprising a Guerbet alcohol ethoxylate, wherein said Guerbet alcohol ethoxylate has the formula $R^1$—$(OC_2H_4)_n$—(OH), wherein R1 is a branched C2-C20 alkyl group, and n is from 2 to 20.

29. The composition of claim 8, further comprising a Guerbet alcohol ethoxylate, wherein said Guerbet alcohol ethoxylate has the formula $R^1$—$(OC_2H_4)_n$—(OH), wherein R1 is a branched C2-C20 alkyl group, and n is from 2 to 20.

* * * * *

UNITED STATES PATENT AND TRADEMARK OFFICE

CERTIFICATE OF CORRECTION

PATENT NO. : 8,901,063 B2
APPLICATION NO. : 13/689876
DATED : December 2, 2014
INVENTOR(S) : Soontravanich et al.

It is certified that error appears in the above-identified patent and that said Letters Patent is hereby corrected as shown below:

In The Claims

Col. 35, Claim 10, Line 58:
Delete after ethoxylation "B"

Signed and Sealed this
Twenty-first Day of April, 2015

Michelle K. Lee

Michelle K. Lee
*Director of the United States Patent and Trademark Office*